US012630327B1

(12) United States Patent
Poplin

(10) Patent No.: US 12,630,327 B1
(45) Date of Patent: May 19, 2026

(54) BOTTLES FOR PACKAGING LIQUIDS FOR RETAIL

(71) Applicant: Higenes Holdings, LLC, Overland Park, KS (US)

(72) Inventor: Allen Justin Poplin, Round Mountain, TX (US)

(73) Assignee: Higenes Holdings, LLC, Overland Park, KS (US)

( * ) Notice: Subject to any disclaimer, the term of this patent is extended or adjusted under 35 U.S.C. 154(b) by 0 days.

(21) Appl. No.: 17/804,889

(22) Filed: Jun. 1, 2022

Related U.S. Application Data

(63) Continuation of application No. 16/589,345, filed on Oct. 1, 2019, now Pat. No. 11,420,783, which is a continuation-in-part of application No. 16/267,854, filed on Feb. 5, 2019, now abandoned.

(51) Int. Cl.

| | |
|---|---|
| ***B65D 1/02*** | (2006.01) |
| ***B65D 39/00*** | (2006.01) |
| ***B65D 51/24*** | (2006.01) |
| ***B65D 85/72*** | (2006.01) |

(52) U.S. Cl.
CPC ..... *B65D 1/0246* (2013.01); *B65D 1/0276* (2013.01); *B65D 39/0005* (2013.01); *B65D 51/24* (2013.01); *B65D 85/72* (2013.01)

(58) Field of Classification Search
CPC ..... B65D 1/0246; B65D 1/0276; B65D 39/0005; B65D 51/24; B65D 85/72; B65D 2547/00–066; B65D 47/06; B65D 47/061; B65D 47/068
See application file for complete search history.

(56) References Cited

U.S. PATENT DOCUMENTS

| | | | | |
|---|---|---|---|---|
| 2,017,209 A | | 10/1935 | Kennedy | |
| 2,175,735 A | | 10/1939 | Banks | |
| 2,566,035 A | * | 8/1951 | Schlumbohm ..... | A47J 36/14 222/572 |
| 2,613,988 A | | 10/1952 | Jarbeau | |

(Continued)

OTHER PUBLICATIONS

Definition of "flared" Cambridge English Dictionary 2016 <https://web.archive.org/web/20160301071200/https://dictionary.cambridge.org/us/dictionary/english/flared> (Year: 2016).*

(Continued)

*Primary Examiner* — Viren A Thakur
(74) *Attorney, Agent, or Firm* — AVEK IP, LLC

(57) ABSTRACT

A bottle for packaging a beverage for retail includes a floor and at least one wall extending upwardly from the floor. The floor and the at least one wall collectively define part of a watertight cavity. A primary spout extends from the at least one wall and has a distal opening spaced apart from the at least one wall. Secondary and tertiary openings are located along the at least one wall or the primary spout and are in communication with the watertight cavity. The secondary opening has an internal perimeter smaller than an internal perimeter of the primary spout distal opening. Primary, secondary, and tertiary closures are configured to removably seal the primary spout distal opening, the secondary opening, and the tertiary opening. A tube has a flared receptacle end and a submersible end configured to pass through the secondary opening for adding content to the watertight cavity.

32 Claims, 22 Drawing Sheets

(56) References Cited

U.S. PATENT DOCUMENTS 2,618,409 A 11/1952 Sidney et al.
3,926,348 A 12/1975 Lutzker
4,705,191 A * 11/1987 Itzel ..... B65D 51/2842 141/95
4,909,437 A 3/1990 Kang
4,925,063 A * 5/1990 Ali ..... B65D 47/06 222/545
4,996,066 A 2/1991 Love et al.
5,465,835 A * 11/1995 Schumacher ..... B65D 81/3222 215/DIG. 8
5,662,249 A * 9/1997 Grosse ..... B65D 51/24 141/381
5,788,125 A 8/1998 Steiner et al.
5,836,479 A 11/1998 Klima et al.
5,850,940 A 12/1998 Sloan et al.
5,890,624 A * 4/1999 Klima ..... B05B 11/00 222/129
6,116,446 A 9/2000 Haughton et al.
6,152,198 A * 11/2000 Nguyen ..... B67C 11/02 141/338
6,319,453 B1 * 11/2001 Klima, Jr. ..... B65D 1/023 264/537
6,431,382 B1 8/2002 Li
6,854,888 B1 * 2/2005 Brown ..... A45F 3/20 383/41
8,523,017 B2 * 9/2013 Vellutato, Jr. ..... B05B 11/048 222/145.5
2002/0030064 A1 * 3/2002 Lacout ..... B65D 81/3211 222/478
2003/0000961 A1 * 1/2003 Klima ..... B05B 11/0056 222/83.5
2003/0072850 A1 * 4/2003 Burniski ..... B65D 47/243 426/115
2005/0173271 A1 * 8/2005 Levi ..... B65D 51/2821 206/219
2005/0184026 A1 8/2005 Haley
2008/0156674 A1 7/2008 Correale et al.
2008/0289976 A1 * 11/2008 Henry ..... B65D 81/3211 206/222
2009/0050637 A1 2/2009 Shetty et al.
2009/0065379 A1 * 3/2009 Casey ..... B65D 1/023 206/221
2009/0107582 A1 4/2009 Sayage
2009/0120892 A1 * 5/2009 Britton ..... B65D 81/3205 215/6
2010/0025350 A1 * 2/2010 Kenney ..... B65D 81/3222 215/6
2013/0025740 A1 * 1/2013 Osten ..... B65D 25/38 220/254.2
2013/0146620 A1 6/2013 Ghezelayagh
2015/0344166 A1 * 12/2015 Davis ..... B65D 23/02 413/1
2017/0152084 A1 * 6/2017 Giovannini ..... B65D 1/0246
2017/0158424 A1 6/2017 Brown
2017/0267409 A1 9/2017 Hudson et al.
2018/0339805 A1 11/2018 Finell
2019/0084738 A1 * 3/2019 Yang ..... B65D 85/72
2019/0351351 A1 11/2019 Singh

OTHER PUBLICATIONS

Definition of "about." Merriam-Webster Jul. 13, 2017. http://web.archive.org/web/20170713101037/https://www.merriam-webster.com/dictionary/about (Year: 2017).

* cited by examiner

BOTTLES FOR PACKAGING LIQUIDS FOR RETAIL

RELATED APPLICATIONS

This application is a continuation of U.S. patent application Ser. No. 16/589,345, filed Oct. 1, 2019, which is a continuation-in-part of U.S. patent application Ser. No. 16/267,854, filed Feb. 5, 2019; the contents of each are incorporated by reference herein in their entirety.

FIELD OF THE DISCLOSURE

The disclosure relates generally to the field of packaging. More specifically, the disclosure relates to bottles for packaging liquids for retail.

SUMMARY

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

According to an embodiment, a bottle for packaging a beverage for retail includes a floor and at least one wall extending upwardly from the floor. The floor and the at least one wall collectively define part of a watertight cavity. A primary spout extends from the at least one wall, and the primary spout has a distal opening spaced apart from the at least one wall by a hollow extension. A secondary opening is located along the at least one wall or the primary spout and is in communication with the watertight cavity. The secondary opening has an internal perimeter that is smaller than an internal perimeter of the primary spout distal opening. A tertiary opening is located along the at least one wall or the primary spout and is in communication with the watertight cavity. A primary closure is configured to removably seal the primary spout distal opening, a secondary closure is configured to removably seal the secondary opening, and a tertiary closure is configured to removably seal the tertiary opening. A tube has a submersible end and a flared receptacle end. The submersible end is configured to pass through the secondary opening for adding content to the watertight cavity.

According to another embodiment, a bottle has a package configuration for packaging an alcoholic beverage for retail and an alternate configuration for adding content into the bottle. The bottle includes a floor and at least one wall extending upwardly from the floor, and the floor and the at least one wall collectively define part of a watertight cavity. A primary spout extends from the at least one wall, and the primary spout has a distal opening spaced apart from the at least one wall by a hollow extension. A secondary opening is located along the at least one wall or the primary spout and is in communication with the watertight cavity. The secondary opening has an internal perimeter that is smaller than an internal perimeter of the primary spout distal opening. A tertiary opening is located along the at least one wall or the primary spout and is in communication with the watertight cavity. The bottle further includes a primary closure, a secondary closure, a tertiary closure, and a tube having a submersible end and a flared receptacle end. The primary closure, the secondary closure, the tertiary closure, and the tube are configured such that at the package configuration: the primary closure seals the primary spout distal opening, the secondary closure seals the secondary opening, the tertiary closure seals the tertiary opening, and the flared receptacle end of the tube is inside the bottle. The primary closure, the secondary closure, the tertiary closure, and the tube are configured such that at the alternate configuration: the primary closure is separated from the primary spout distal opening, the secondary closure is separated from the secondary opening, the tertiary closure is separated from the tertiary opening, the tube passes through the secondary opening, the submersible end of the tube is in the watertight cavity, and the flared receptacle end of the tube is outside the bottle.

According to still another embodiment, a bottle for retail includes a floor and at least one wall extending upwardly from the floor, and the floor and the at least one wall collectively define part of a watertight cavity. An alcoholic beverage is in the watertight cavity. A primary spout extends from the at least one wall, and the primary spout has a distal opening spaced apart from the at least one wall by a hollow extension. A secondary opening is located along the at least one wall or the primary spout and is in communication with the watertight cavity. The secondary opening has an internal perimeter that is smaller than an internal perimeter of the primary spout distal opening. A tertiary opening is located along the at least one wall or the primary spout and is in communication with the watertight cavity. A primary closure is configured to removably seal the primary spout distal opening, a secondary closure is configured to removably seal the secondary opening, a tertiary closure is configured to removably seal the tertiary opening, and a tube extends from the secondary opening. The tube has a submersible end and a flared receptacle end, and the submersible end is inside the watertight cavity.

DETAILED DESCRIPTION

Figure 1A:
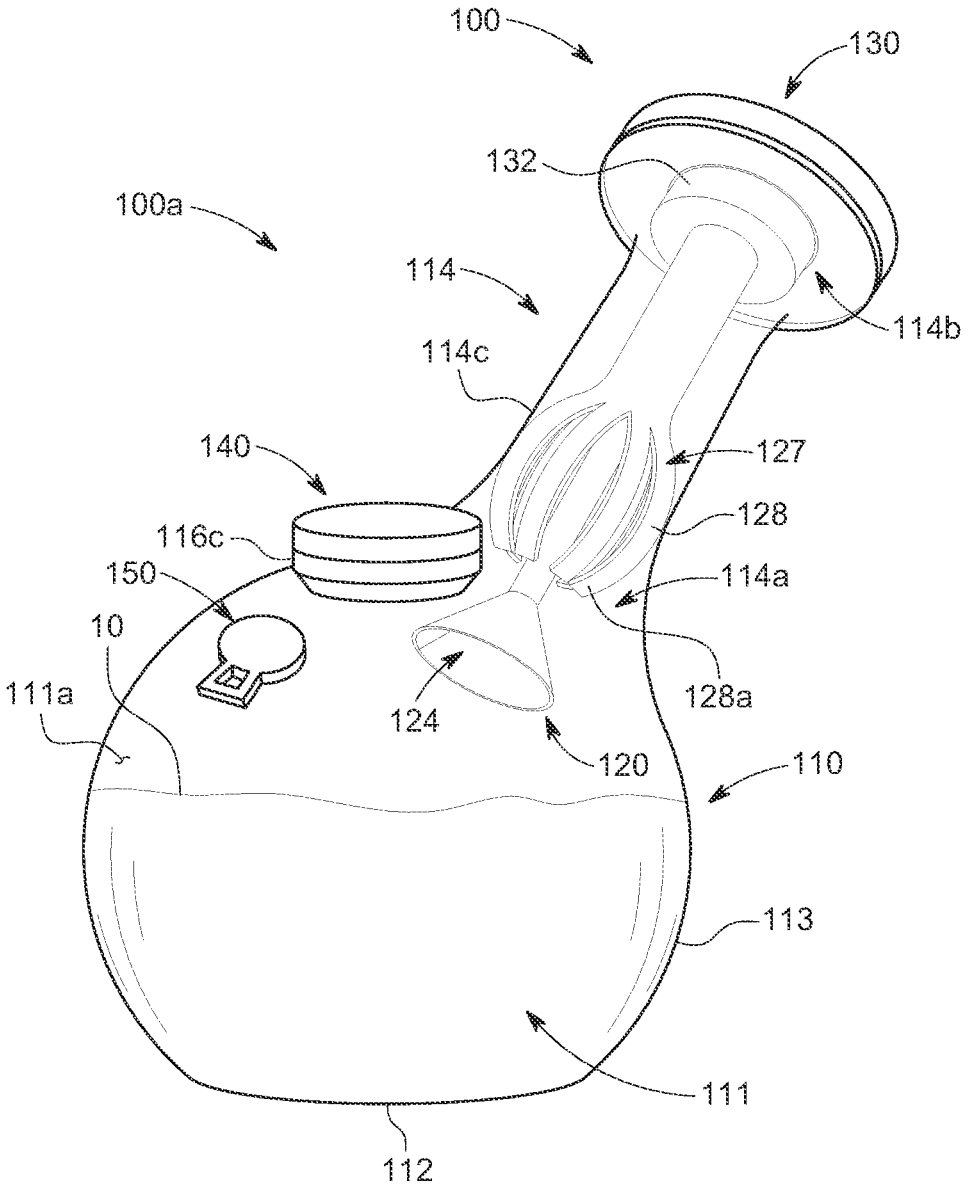
FIG. 1A is a perspective view of a bottle for packaging fluids for retail, according to an embodiment of the present disclosure, at a package configuration.

Bottles for packaging liquids for retail are typically designed to ensure that there is no leakage of the liquid while taking a minimum amount of shipping container and/or shelf space. Additional considerations include such things as durability and bottle color (which may affect penetration of UV rays, and ultimately the flavor of the liquid). To ensure that there is no leakage, bottles for packaging liquids typically have a single opening that is sealed with either a pressure fitting (e.g., a natural or synthetic cork), a threaded cap, or a swing-top cap (also commonly called a flip-top cap).

FIGS. 1A through 4 illustrate a bottle for packaging liquids for retail, according to an embodiment 100 of the current invention. The bottle 100 broadly includes an exterior perimeter 110, a primary spout 114, a secondary opening 116, a tertiary opening 118, a tube (or "straw") 120, a primary closure 130, a secondary closure 140, and a tertiary closure 150.

The exterior perimeter 110 includes a floor 112 and at least one external wall 113 extending upward from the floor 112, and (along with the primary spout 114) forms a watertight and spill-proof cavity 111 when the primary, secondary, and tertiary closures 130, 140, 150 are attached as discussed below. "Watertight" is used herein to mean capable of retaining water, alcoholic beverage, oil, or other liquid 10, and "spill-proof" is used herein to mean watertight even if turned upside down. A principal portion 111*a* of the watertight cavity 111 is below the primary spout 114 and the secondary and tertiary openings 116, 118. In the embodiment 100, the primary spout 114 is off-centered and extends at an angle to vertical; while such a configuration may be preferred, the primary spout 114 may nevertheless be centered and extend generally vertically in other embodiments. Moreover, in some embodiments, the primary spout 114 may extend from the wall 113 without any significant demarcation between the two elements 114, 113. And while the floor 112 in the embodiment 100 is generally circular and the external wall 113 of the watertight cavity 111 is generally dome-shaped, in other embodiments the floor 112 may be oblong, square, rectangular, irregular, or shaped as otherwise desired; and the at least one external wall 113 may be shaped differently as well. The exterior perimeter 110 may be constructed of glass, polycarbonate, ceramic, and/or other appropriate materials, and may have a thickness, strength, and color selected as desired. The external perimeter 110 may be formed through extrusion, blowing, additive manufacturing, or any other appropriate processes. In some embodiments, it may be particularly desirable for at least part of the exterior perimeter 110 to be translucent, and even more desirable for at least part of the exterior perimeter 110 to be transparent.

The primary spout 114 has a proximal opening 114*a* at the watertight cavity 111 and a distal opening 114*b* spaced apart from the watertight cavity 111 by a hollow extension 114*c*. The proximal opening 114*a* and the distal opening 114*b* may each be generally circular or shaped as otherwise desired, and the extension 114*c* may be generally cylindrical (or in other words may extend generally linearly along a linear axis), curved, or shaped as otherwise desired. The primary spout 114 may be unthreaded at the distal opening 114*b* (as shown), externally threaded at the distal opening 114*b*, or internally threaded at the distal opening 114*b*.

Figure 2A:
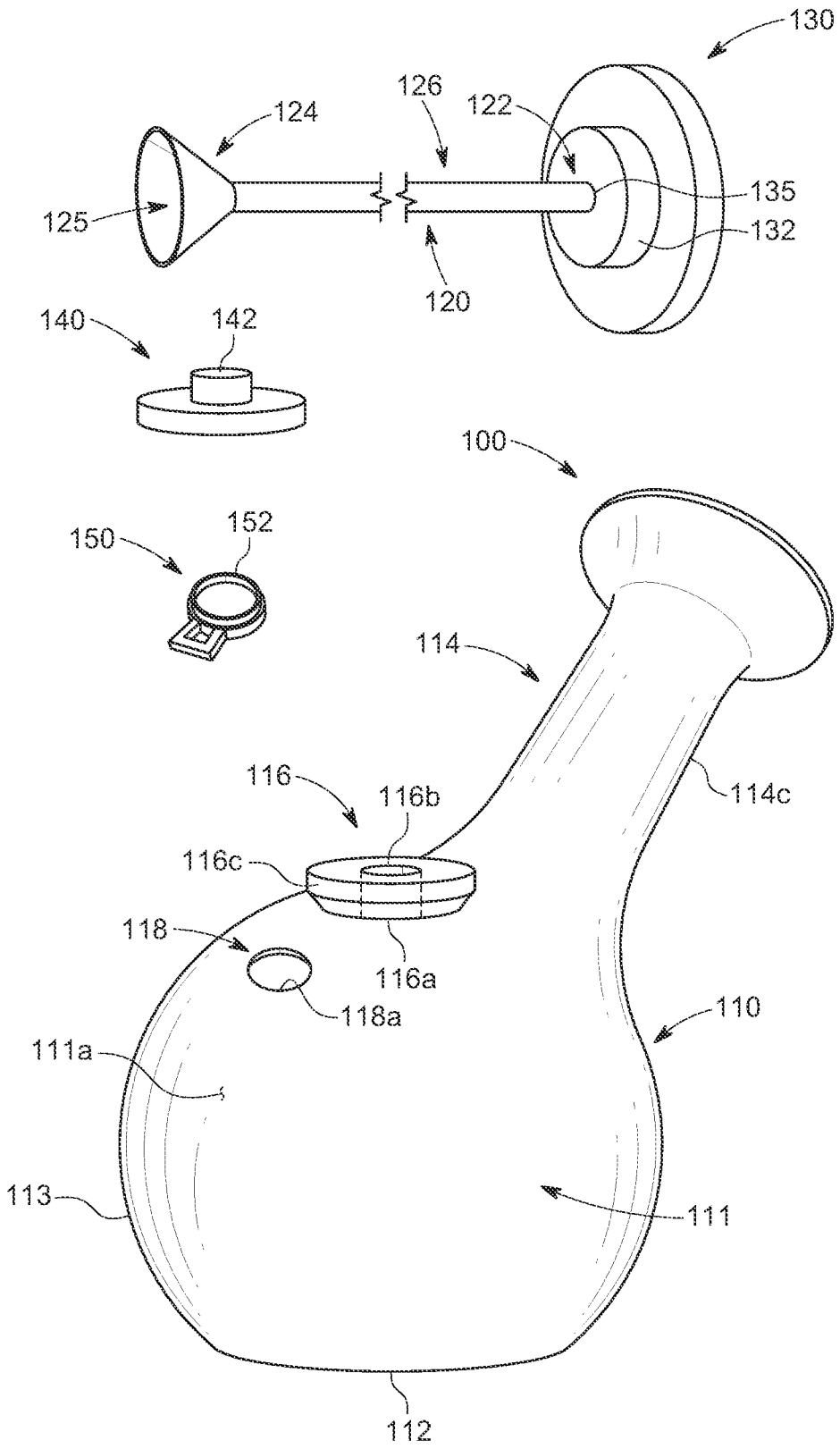
FIG. 2A is a perspective view of the bottle of FIG. 1A, with primary, secondary, and tertiary closures removed and not necessarily shown to scale, and with stabilizer omitted.
Figure 2B:
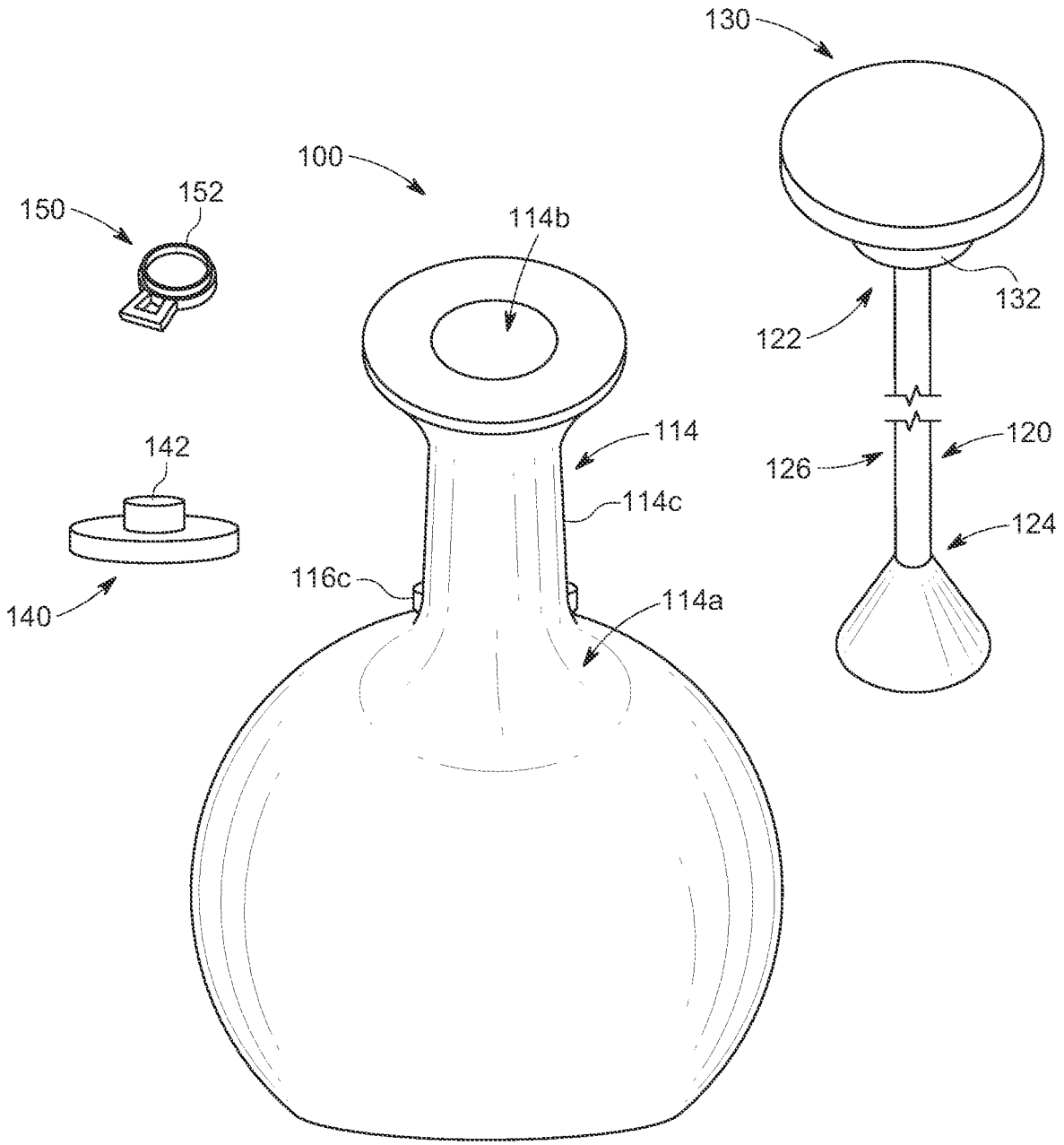
FIG. 2B is another perspective view of the bottle of FIG. 1A, with primary, secondary, and tertiary closures removed and not necessarily shown to scale, and with stabilizer omitted.
Figure 3A:
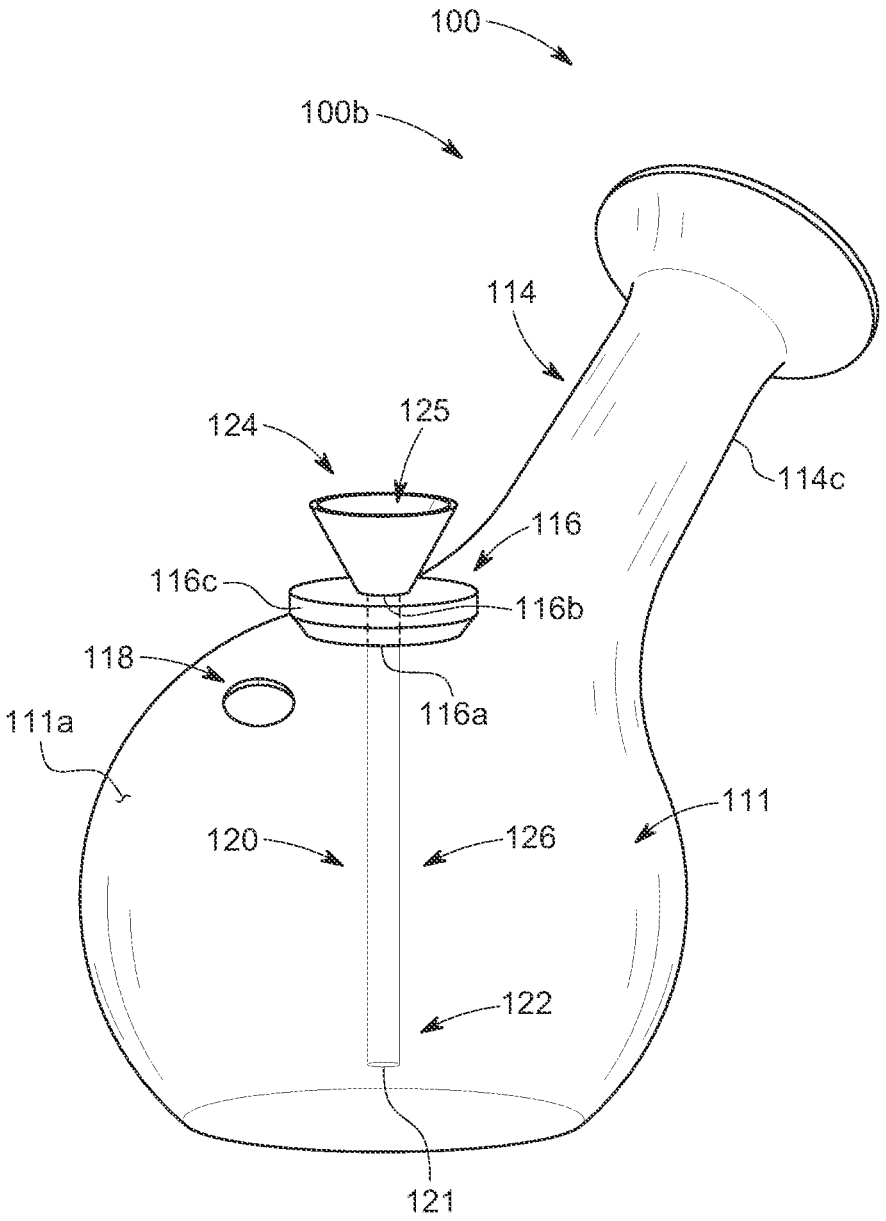
FIG. 3A is a perspective view of the bottle of FIG. 1A, at an alternate configuration.
Figure 3B:
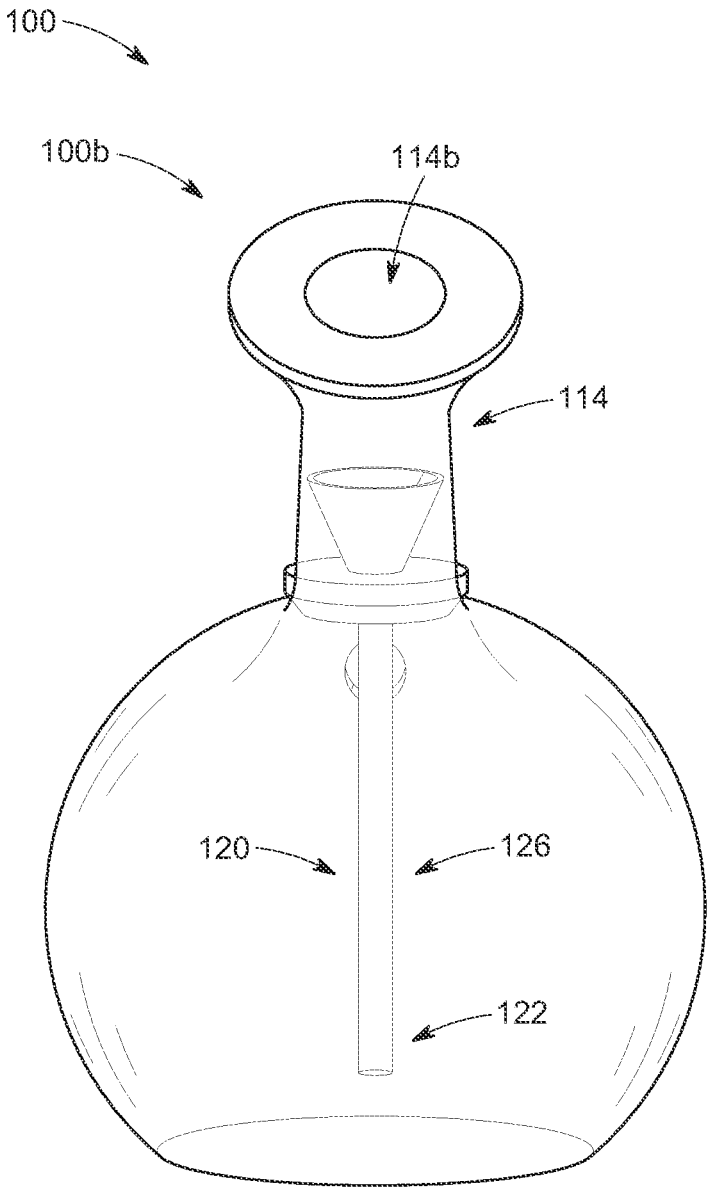
FIG. 3B is another perspective view of the bottle of FIG. 1A, at the alternate configuration and shown fully transparent for illustration.

The secondary opening 116 has a proximal opening 116*a* at the watertight cavity 111 or the primary spout 114. In some embodiments, as shown in FIGS. 1A through 4, the secondary opening 116 also includes a distal opening 116*b* spaced apart from the watertight cavity 111 by a hollow extension 116*c*. The proximal opening 116*a* and the distal opening 116*b* may each be generally circular or shaped as otherwise desired, and the extension 116*c* may be generally cylindrical (or in other words may extend generally linearly along a linear axis), curved, or shaped as otherwise desired so long as the tube 120 may function as described below. The distal opening 116*b* may be unthreaded (as shown), externally threaded, or internally threaded. In some embodiments, a rubber gasket or other fitting may be placed at the distal opening 116*b* and/or at the proximal opening 116*a* to ensure a secure (i.e., tight) fit between the secondary opening 116 and the tube 120 when the bottle 100 is configured as shown in FIGS. 3A and 3B. Alternately, it may be desirable to have a coating or gasket on the tube 120 to ensure a secure fit between the secondary opening 116 and the tube 120 when the bottle 100 is configured as shown in FIGS. 3A and 3B. In the embodiment 100, the secondary opening 116 is located along the exterior perimeter 110; but in other embodiments, the secondary opening 116 may be located, for example, along the extension 114*c* of the primary spout 114.

The tertiary opening 118 has a proximal opening 118*a* at the watertight cavity 111. In some embodiments, the tertiary opening 118 also includes a distal opening spaced apart from the watertight cavity 111 by a hollow extension (similar to the distal opening 116*b* and the extension 116*c* in the secondary opening 116 of embodiment 100). The proximal opening 118*a* and the distal opening (if present) may each be generally circular or shaped as otherwise desired, and the extension (if present) may be generally cylindrical, curved, or shaped as otherwise desired. The proximal opening 118*a* of embodiment 100 is unthreaded, but may alternately be internally threaded. If the tertiary opening 118 includes a distal opening, the distal opening of the tertiary opening 118 may be unthreaded, externally threaded, or internally threaded. In the embodiment 100, the tertiary opening 118 is located along the exterior perimeter 110; but in other embodiments, the tertiary opening 118 may be omitted entirely or located, for example, along the extension 114*c* of the primary spout 114.

It may be preferable for internal and external perimeters (e.g., internal and external circumferences) of the primary spout distal opening 114*b* to be respectively larger than internal and external perimeters of the distal opening 116*b* of the secondary opening 116 (and respectively larger than internal and external perimeters of the distal opening of the tertiary opening 118, if present). If the tertiary opening 118 has a distal opening, it may be preferable for the internal perimeter of that distal opening to be sized differently (either smaller or larger) than the internal perimeter of the secondary opening distal opening 116*b*; and especially if the tertiary opening 118 does not have a distal opening, it may be preferable for the perimeter of the tertiary opening proximal opening 118*a* to be sized differently (either smaller or larger) than the internal perimeter of the secondary opening distal opening 116*b*.

The tube 120 has a submersible end 122 and a flared receptacle end 124, separated from one another by a length portion 126. The receptacle end 124 defines a receiving area 125, and a passage 121 extends entirely through the tube 120 (i.e., from the submersible end 122, through the length portion 126, and to the receptacle end 124). It may be desirable for the length portion 126 to have a generally uniform diameter, and for that diameter to be generally the same as the internal perimeter of the distal opening 116*b* of the secondary opening 116, either directly or with the gasket (or if no distal opening 116*b*, generally the same as the internal perimeter of the proximal opening 116*a* of the secondary opening 116, either directly or with the gasket). The tube 120 may be constructed of glass and/or other appropriate materials.

In some embodiments, a stabilizer 127 extends from the tube 120. The stabilizer 127 may be formed with the tube 120, though it may be desirable for the stabilizer 127 to instead be formed separately from and then connected to the tube 120 (e.g., through a press fit, adhesion, or any other appropriate fastening method or device). If formed separately and attached, it may be desirable for the tube 120 to include at least one stop or seat feature which the stabilizer 127 may abut, and for the stabilizer 127 to be removable from the tube 127. The stabilizer 127 may in effect increase the diameter of the tube 120 and stabilize the tube 120 inside the primary spout 114, and may be resilient such that the stabilizer 127 is biased toward an extended configuration but may be compressed or otherwise retracted when sufficient force is applied. It may be particularly desirable for such compression to automatically occur when the tube 120 and the stabilizer 127 are removed from the primary spout 114 as discussed below.

Figure 10:
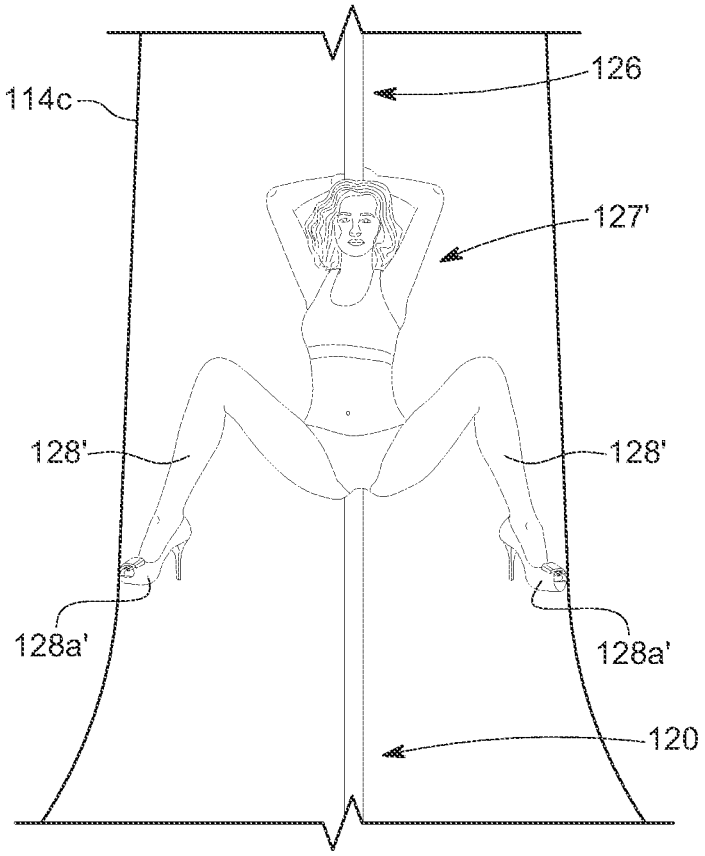
FIG. 10 is a front view illustrating a stabilizer according to another embodiment, for use with the disclosed bottles.
Figure 11:
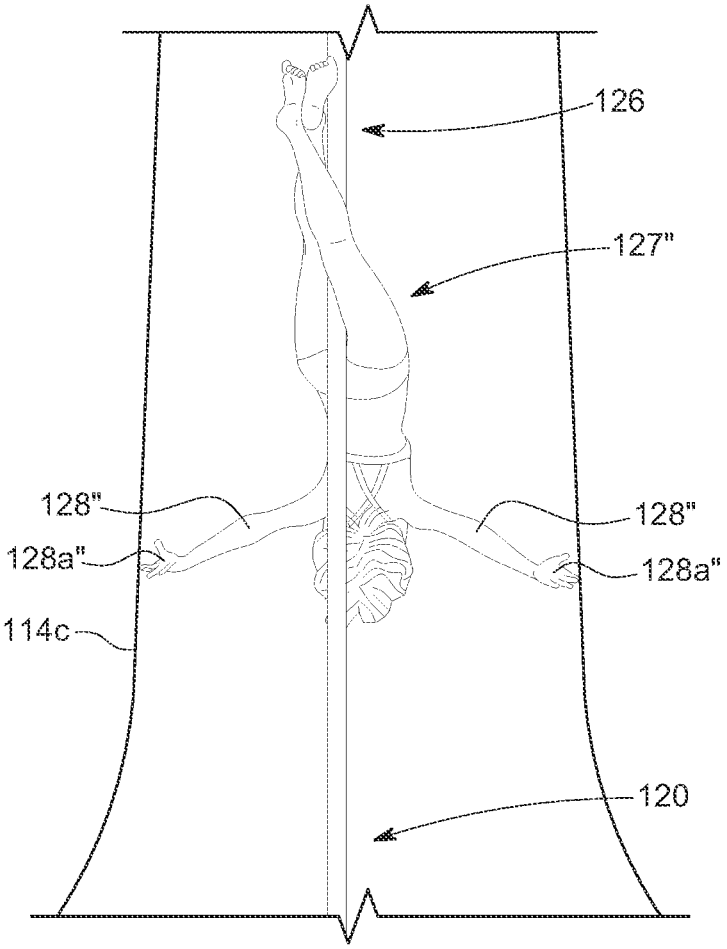
FIG. 11 is a front view illustrating a stabilizer according to still another embodiment, for use with the disclosed bottles.

In the embodiment 100, the stabilizer 127 has a plurality of resilient arms 128, each with a free end 128*a* initially pointed away from the primary spout distal opening 114*b* (and toward the flared receptacle end 124). In some embodiments, the stabilizer 127 may be configured in the shape of at least one person or other animal or object. One such alternate embodiment 127' of the stabilizer 127 is shown in FIG. 10. The stabilizer 127' is shaped as a person, with the person's legs 128' functioning as the resilient arms 128. And, as with the embodiment 127, a free end 128*a'* of each leg 128' may be pointed away from the primary spout distal opening 114*b* (and toward the flared receptacle end 124). It may be particularly desirable for the legs 128' (or other elements functioning as the resilient arms 128) to be generally symmetrical laterally about the tube 120, and for the at least one person or object to be posed to interact with the tube 120 (for example, as shown). Another alternate embodiment 127" of the stabilizer 127 is shown in FIG. 11. The stabilizer 127" is also shaped as a person interacting with the tube 120, with the person's arms 128" functioning as the resilient arms 128 and a free end 128*a"* of each arm 128" pointed away from the primary spout distal opening 114*b* (and toward the flared receptacle end 124).

Figure 4:
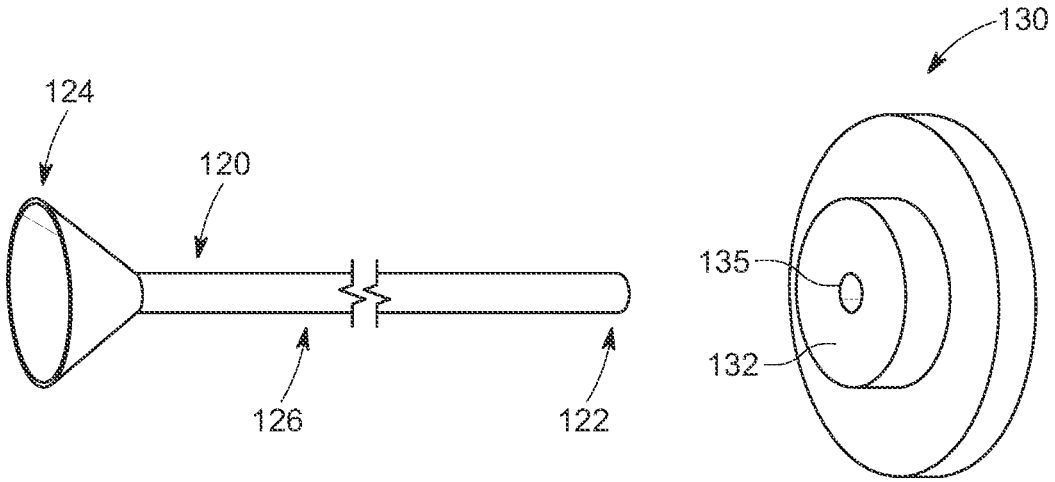
FIG. 4 a perspective view of the straw and the primary closure of FIG. 2A, separated from one another.

Turning now to the primary closure 130, the primary closure 130 is configured complementary to a configuration of the primary spout distal opening 114*b*. So in embodiment 100, which has an unthreaded distal opening 114*b*, the primary closure 130 includes a pressure fitting 132 for being inserted in and sealing the distal opening 114*b*. The pressure fitting 132 may include natural or synthetic cork, rubber, and/or any other appropriate material. In embodiments having threading at the distal opening 114*b*, the primary closure 130 may include complementary threading to allow the primary closure 130 to seal the distal opening 114*b*. As best shown in FIGS. 2A and 4, the primary closure 130 may further include a cavity 135 for receiving the submersible end 122 of the tube 120 (for example, in a press fit).

The secondary closure 140 is configured complementary to a configuration of the secondary opening 116. So in embodiment 100, which has an unthreaded distal opening 116*b*, the secondary closure 140 includes a pressure fitting 142 for being inserted in and sealing the distal opening 116*b*. The pressure fitting 142 may include natural or synthetic cork, rubber, and/or any other appropriate material. In embodiments having threading at the distal opening 116*b*, the secondary closure 140 may include complementary threading to allow the secondary closure 140 to seal the distal opening 116*b*.

The tertiary closure 150 is configured complementary to a configuration of the tertiary opening 118. So in embodiment 100, which has an unthreaded proximal opening 118*a* and no distal opening for the tertiary opening 118, the tertiary closure 150 includes a pressure fitting 152 for being inserted in and sealing the proximal opening 118*a*. In other embodiments having an unthreaded proximal opening 118*a* and no distal opening for the tertiary opening 118, the tertiary closure 150 may be a wrap or cover which is selectively removable. In some embodiments, the pressure fitting 152, wrap, or cover may be removable and replaceable; in other embodiments, the tertiary opening 118 may be permanently open after the pressure fitting 152, wrap, or cover is removed.

Figure 1B:
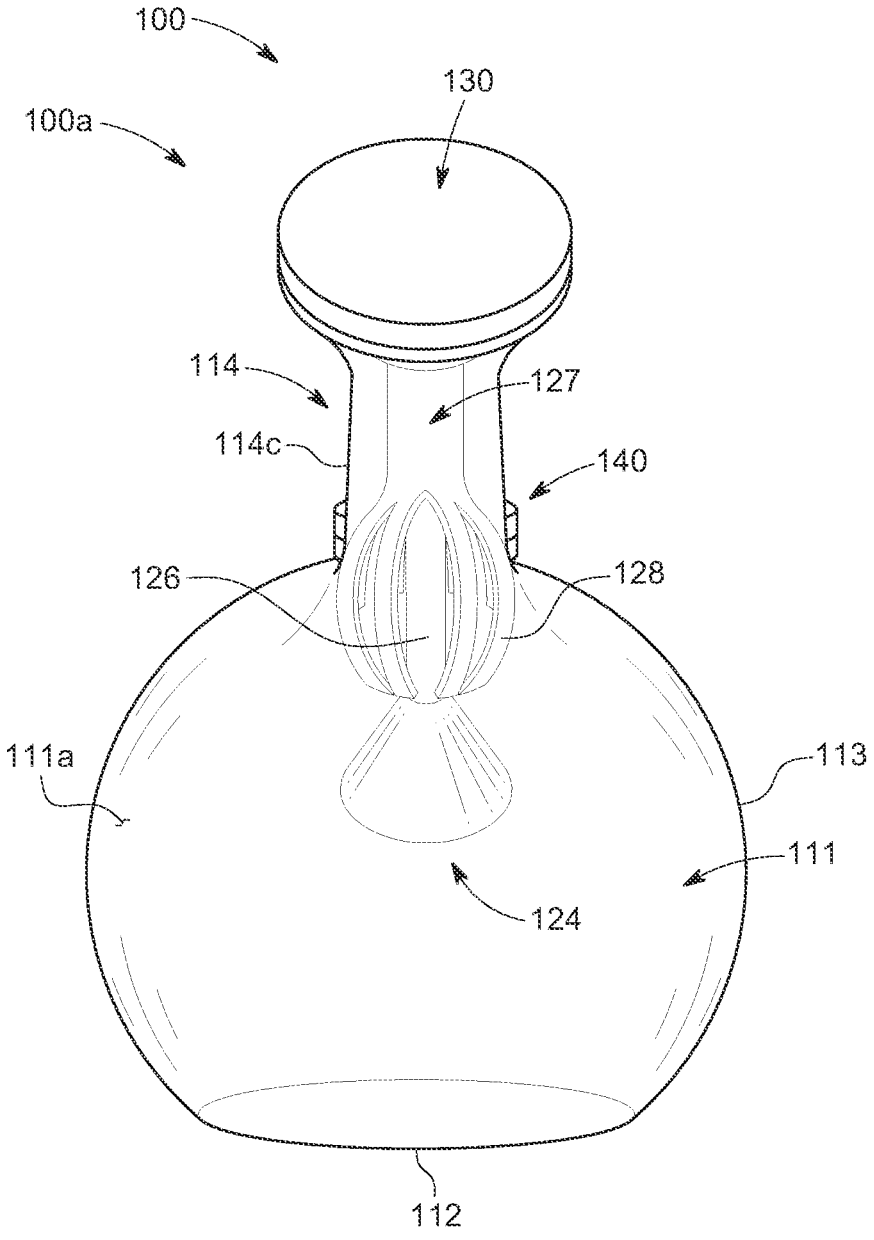
FIG. 1B is another perspective view of the bottle of FIG. 1A, at the package configuration.

In use, the exterior perimeter 110 is initially formed along with the primary spout 114 and the secondary and tertiary openings 116, 118. The submersible end 122 of the tube 120 is press fit into the cavity 135 of the primary closure 130, and the liquid 10 is added to the principal portion 111*a* of the watertight cavity 111. The liquid 10 may be added through the primary spout 114, the secondary opening 116, and/or the tertiary opening 118. If the liquid 10 is not added through a respective element 114, 116, 118, the closure for that element 114, 116, 118 may be coupled either before or after the liquid 10 is added. For example, if the liquid 10 is not added through the tertiary opening 118, the pressure fitting 152 of the tertiary closure 150 may be press fit into the proximal opening 118*a* either before or after the liquid 10 is added. After the liquid 10 is added, any of the closures 130, 140, 150 that are not already coupled are then coupled (e.g., the pressure fitting 132 of the primary closure 130 may be press fit into the distal opening 114*b* of the primary spout 114, the pressure fitting 142 of the secondary closure 140 may be press fit into the distal opening 116*b* of the secondary opening 116, and the pressure fitting 152 of the tertiary closure 150 may be press fit into the proximal opening 118*a* of the tertiary opening 118). If desired, shrink wrap or wax may then be applied to any or all of the closures 130, 140, 150 to ensure that the closures 130, 140, 150 remain in place and also provide a tamper-indicating seal. Once the liquid 10 is added and the closures 130, 140, 150 are coupled, the bottle 100 is at a package configuration 100*a* (FIGS. 1A and 1B). While the bottle 100 is at the package configuration 100*a*, it may (along with its contents) be transported and sold without leakage, and the stabilizer 127 may stabilize the tube 120 inside the primary spout 114 and prevent the tube 120 from breaking or separating from the primary closure 130.

To access the liquid 10, the user may remove the primary closure 130 (and with it, the tube 120) and pour the liquid 10 from the primary spout 114. As the tube 120 is being removed from the primary spout 114, the stabilizer 127 retracts if necessary such that the tube 120 and the stabilizer 127 may be withdrawn from the primary spout 114 without undue force. To assist in pouring and prevent a vacuum effect, the secondary closure 140 and/or the tertiary closure 150 may be removed before or while the liquid 10 is poured through the primary spout 114. Alternately, the liquid 10 may be poured through the secondary opening 116 and/or the tertiary opening 118. To re-secure any remaining liquid 10, any replaceable closure 130, 140, 150 may be reinserted; the primary closure 130 may be reinserted either with the tube 120, or after the tube 120 is removed.

Whether after or before the liquid 10 is dispensed from the bottle 100, the tube 120 may be removed from the primary closure 130, the stabilizer 127 may be removed from the tube 120, the secondary closure 140 may be removed from the secondary opening 116, and the submersible end 122 of the tube 120 may be inserted through the secondary opening 116 (as shown in FIGS. 3A and 3B). At this alternate configuration 100*b*, the flared receptacle end 124 of the tube 120 may assist a user to add content to the watertight cavity 111 (and preferably to the principal portion 111*a* of the watertight cavity 111) through the tube 120. That added content may remain in the watertight cavity 111 or be dispensed (i.e., through the primary spout 114 and/or the tertiary opening 118).

Figure 5:
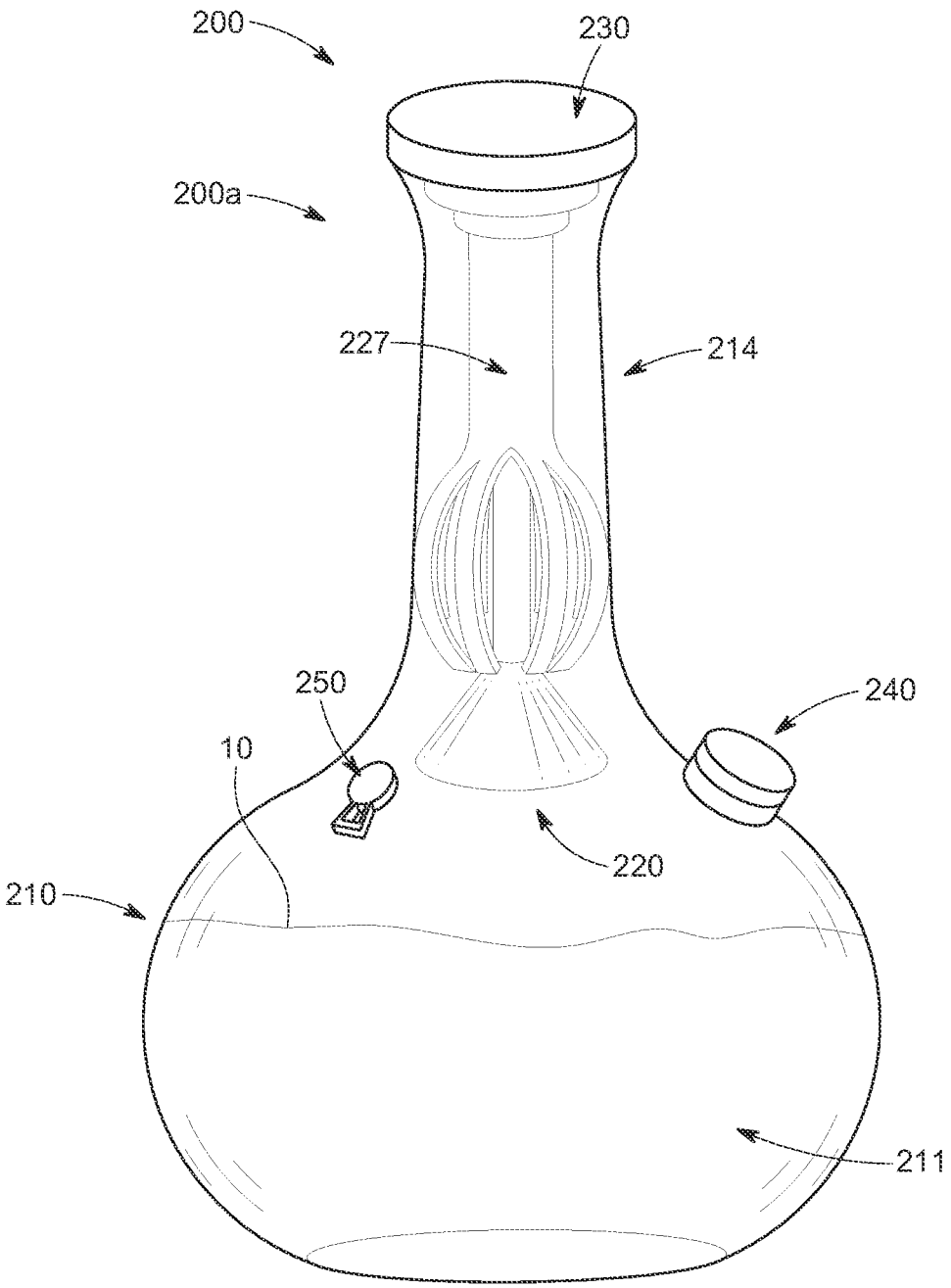
FIG. 5 is a perspective view of a bottle for packaging fluids for retail, according to another embodiment of the present disclosure, at a package configuration.
Figure 6:
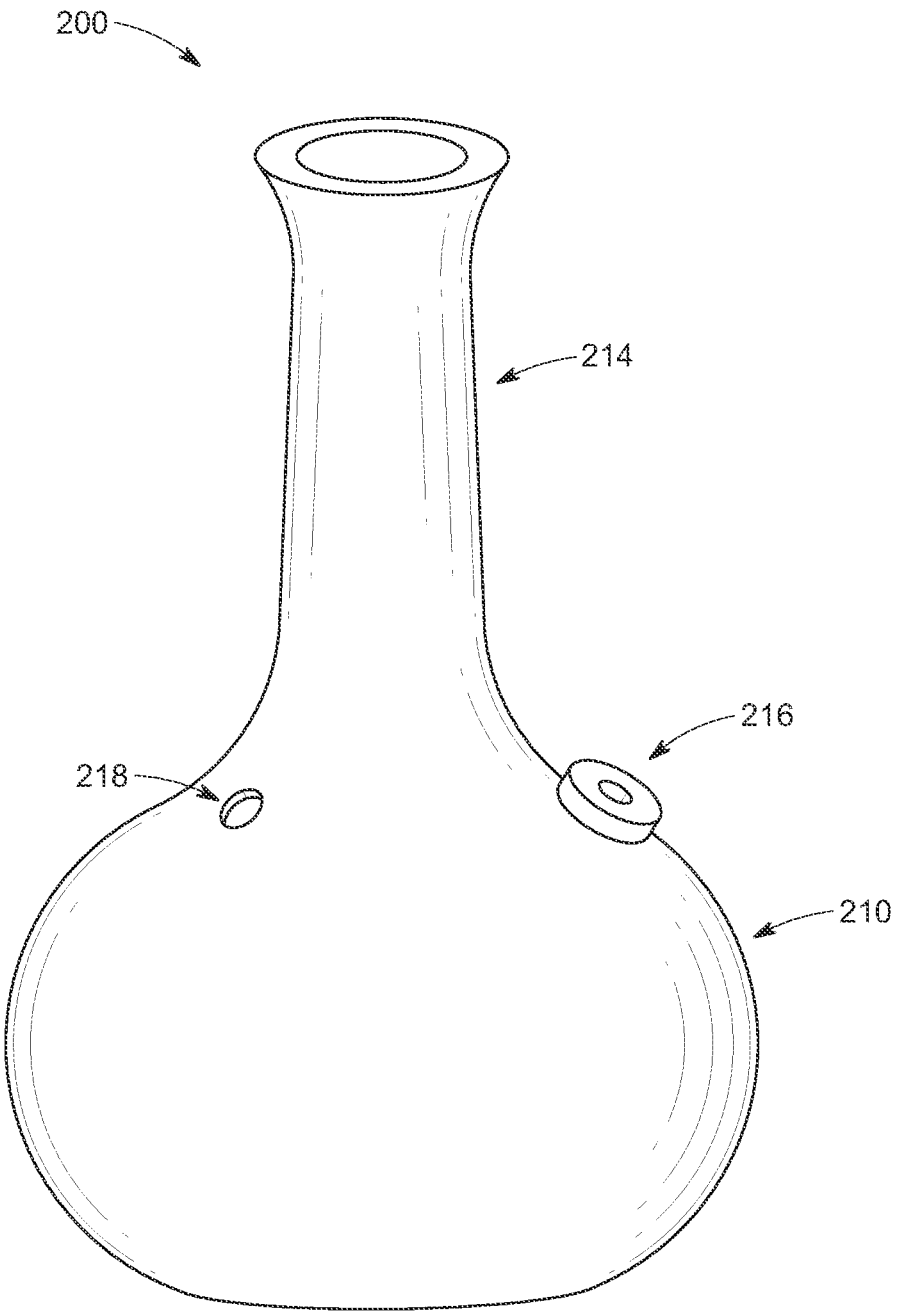
FIG. 6 is a perspective view of the bottle of FIG. 5, with primary, secondary, and tertiary closures removed and omitted.
Figure 7:
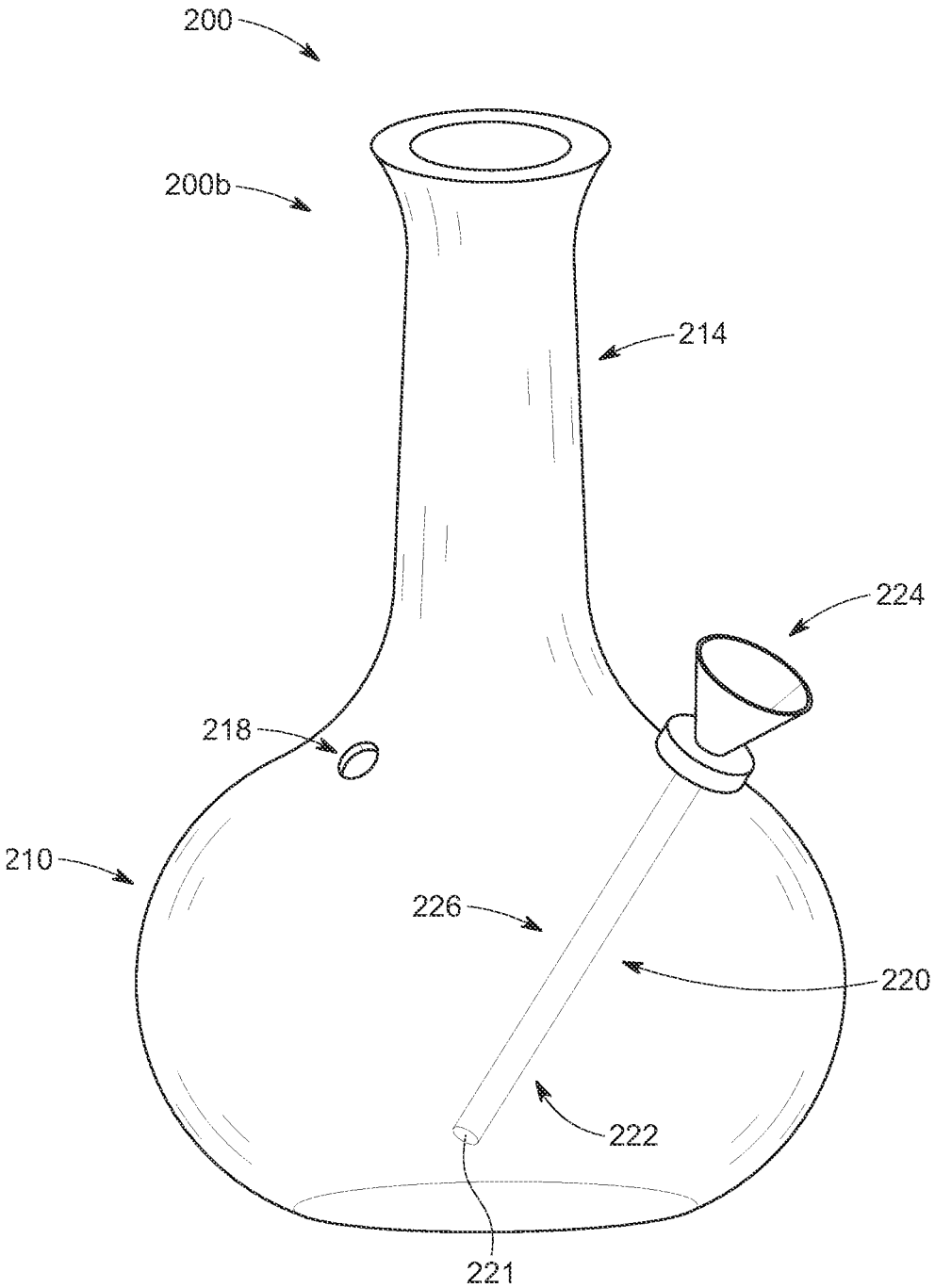
FIG. 7 is a perspective view of the bottle of FIG. 5, at an alternate configuration.

FIGS. 5 through 7 show another bottle 200 for packaging liquids for retail, according to an embodiment of the current disclosure. The bottle 200 is substantially similar to the bottle 100 described above, except as specifically noted and/or shown, or as would be inherent. Further, those skilled in the art will appreciate that the embodiments 100, 200 may be modified in various ways, such as through incorporating all or part of any of the various described embodiments, for example. For uniformity and brevity, reference numbers from 200 to 299 may be used to indicate elements corresponding to those discussed above numbered from 100 to 199 (e.g., package configuration 200*a* corresponds generally to the package configuration 100*a*; alternate configuration 200*b* corresponds generally to the alternate configuration 100*b*; exterior perimeter 210 corresponds generally to the exterior perimeter 110; watertight cavity 211 corresponds generally to the watertight cavity 111; primary spout 214 corresponds generally to the primary spout 114; secondary opening 216 corresponds generally to the secondary opening 116; tertiary opening 218 corresponds generally to the tertiary opening 118; tube 220 corresponds generally to the tube 120; tube passage 221 corresponds generally to the tube passage 121; tube submersible end 222 corresponds generally to the tube submersible end 122; tube receptacle end 224 corresponds generally to the tube receptacle end 124; tube length portion 226 corresponds generally to the tube length portion 126; stabilizer 227 corresponds generally to the stabilizer 127; primary closure 230 corresponds generally to the primary closure 130; secondary closure 240 corresponds generally to the secondary closure 140; and tertiary closure 250 corresponds generally to the tertiary closure 150), though with any noted, shown, or inherent deviations.

The bottle 200 primarily differs from the bottle 100 in shape, and both bottles 100, 200 are used as set forth above. While the primary spout 114 is off-centered and extends at an angle to vertical, the primary spout 214 is generally centered and extends generally vertically. And while both embodiments 100, 200 show the secondary opening 116, 216 and the tertiary opening 118, 218 located separate from the respective primary spout 114, 214, it may be desirable for the secondary opening 116, 216 and/or the tertiary opening 118, 218 to be located along the respective primary spout 114, 214.

Figure 8:
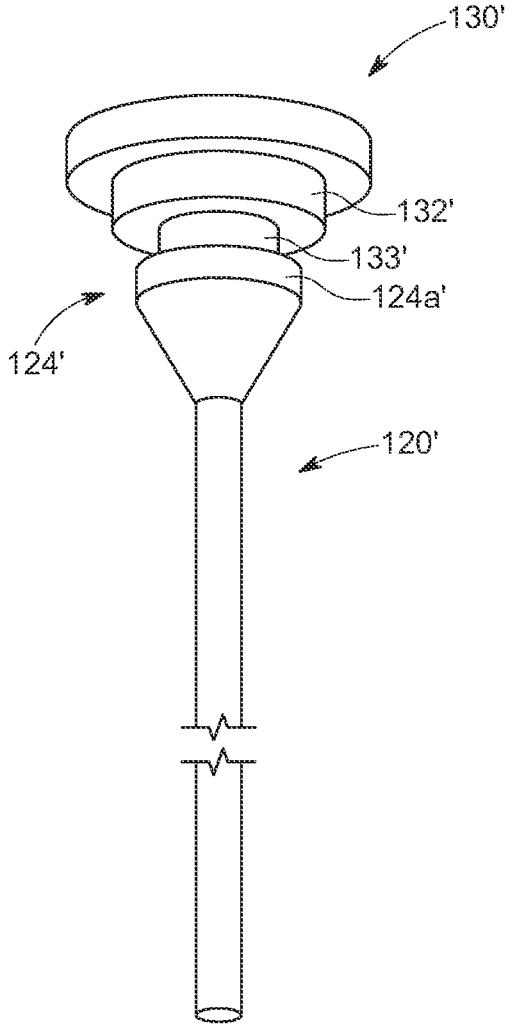
FIG. 8 is a perspective view of a straw coupled to a primary closure, according to still another embodiment of the present disclosure.
Figure 9:
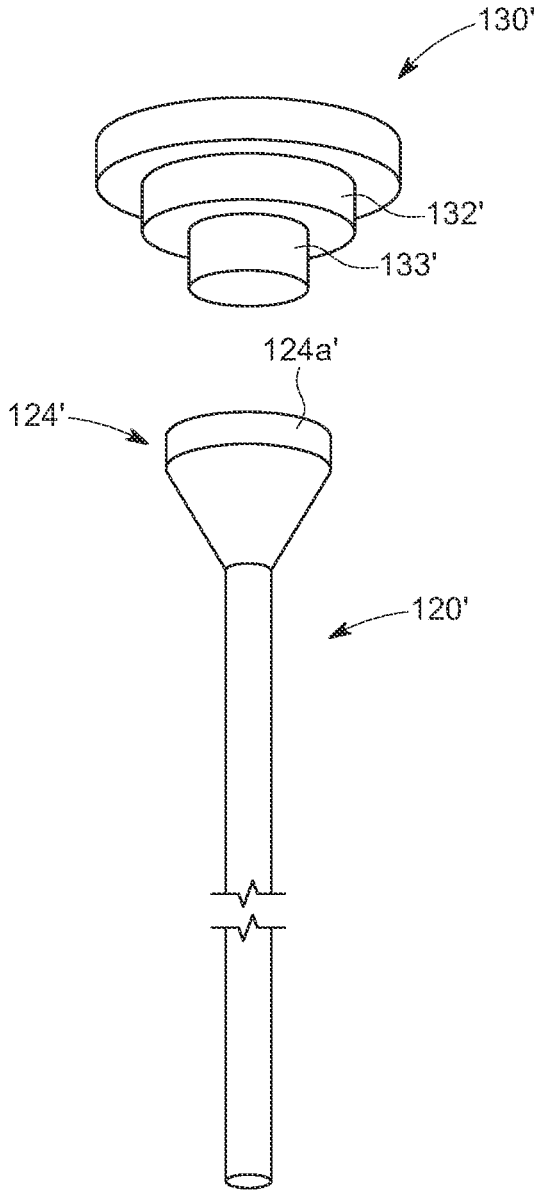
FIG. 9 is a perspective view of the straw and the primary closure of FIG. 8, separated from one another.

FIGS. 8 and 9 show another primary closure 130' and tube 120' for use with each of the embodiments disclosed herein as a replacement for the primary closure 130 (or equivalent element) and the tube 120 (or equivalent element). The main difference between the primary closure 130' and the primary closure 130 is that the primary closure 130' acts as a male coupling for retaining the tube 120' instead of a female coupling for retaining the tube 120'. More particularly, the primary closure 130' includes a pressure fitting 132' that generally corresponds to the pressure fitting 132 for sealing the primary spout distal opening 114*b*, but the primary closure 130' also includes a pressure fitting 133' that fits inside the flared receptacle end 124' (which generally corresponds to the flared receptacle end 124) to couple the tube 120' to the primary closure 130'. It may be desirable for the flared receptacle end 124' to have a generally cylindrical rim 124*a*' to provide a good press-fit interaction. FIG. 8 shows the tube 120' coupled to the primary closure 130', while FIG. 9 shows the tube 120' and the primary closure 130' separated from one another. The primary closure 130' and the tube 120' are used generally as set forth above regarding the embodiment 100, but with the tube 120' generally upside down relative to the tube 120 when the bottle 100 is at the package configuration 100*a*.

While the disclosure above highlights embodiments having a tube 120 (or equivalent element) that is separable from the remainder of the respective bottles, other embodiments may form at least part of the tube 120 (e.g., the submersible end 122 and part or all of the length portion 126) along with the wall 113 or otherwise permanently couple the tube 120 such that the tube 120 extends downwardly from the secondary opening 116. In such embodiments, the flared receptacle end 124 may also be formed with the wall 113 or permanently coupled above the secondary opening 116, or may be coupled to the primary closure 130 generally as discussed above (e.g., through a male/female or female/male interaction) and subsequently coupled to the remainder of the tube 120, or may otherwise be included or omitted.

Figure 12:
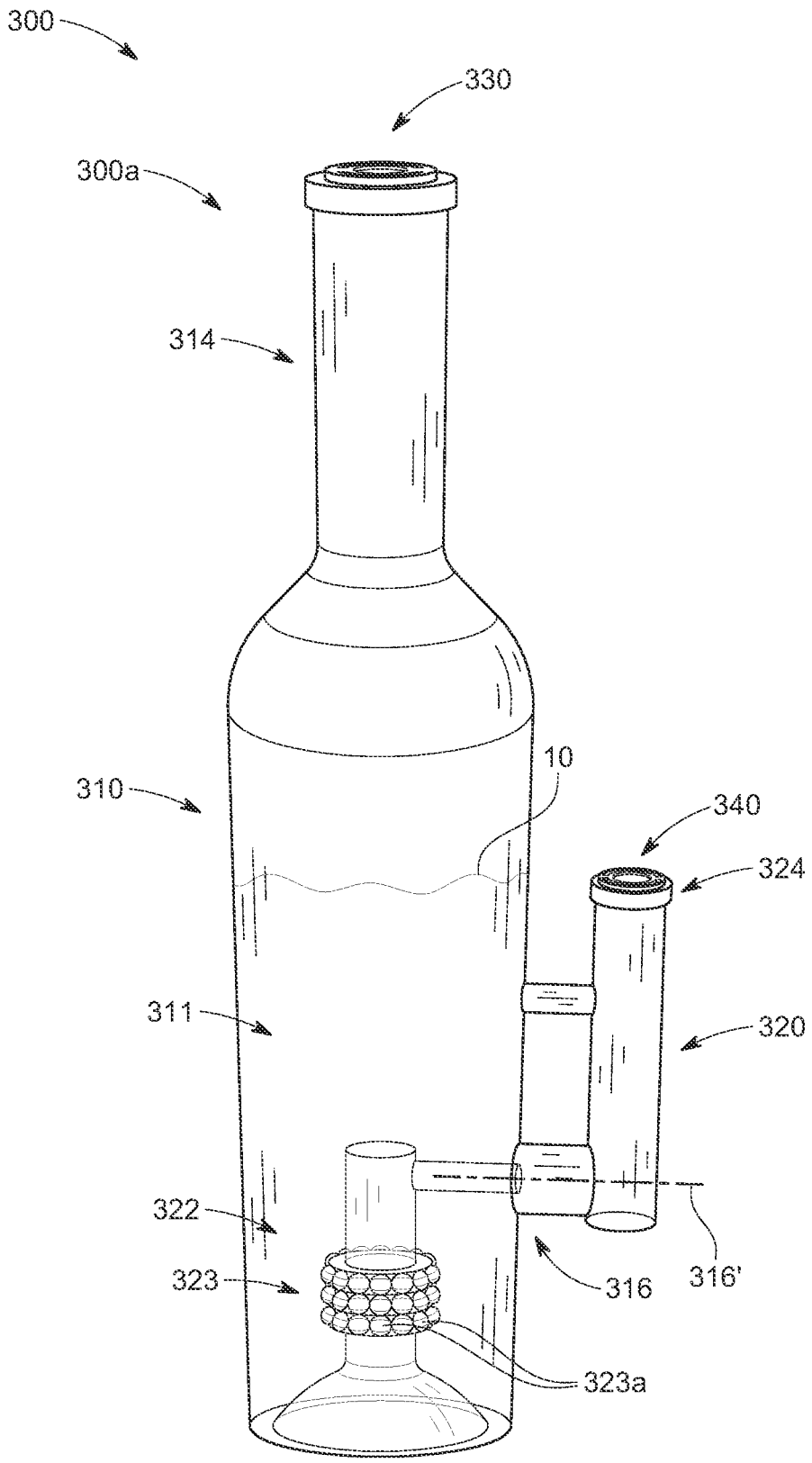
FIG. 12 is a perspective view of a bottle for packaging fluids for retail, according to still another embodiment of the present disclosure, at a package configuration.
Figure 13:
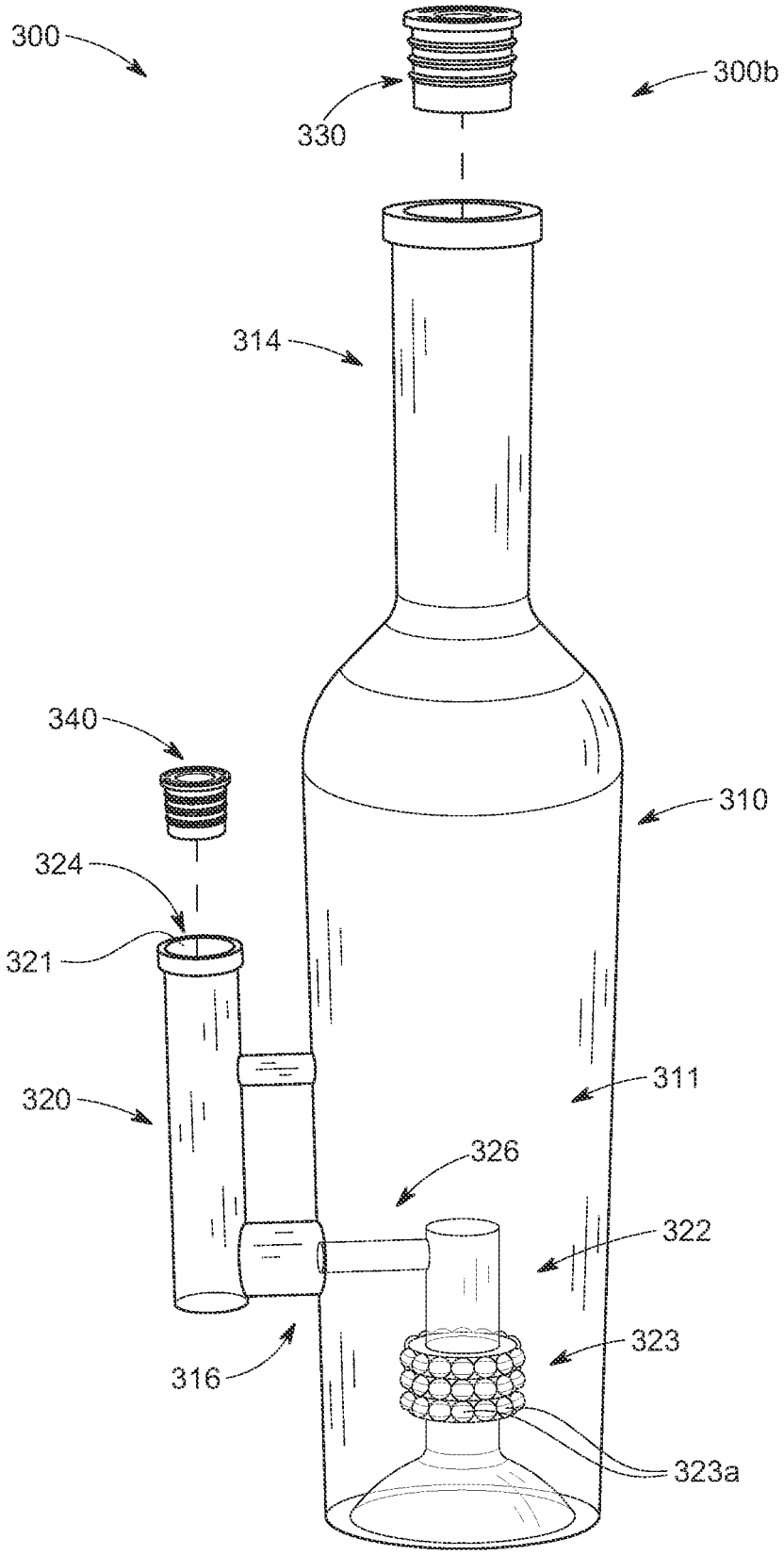
FIG. 13 is another perspective view of the bottle of FIG. 12, with primary and secondary closures removed and not necessarily shown to scale.

FIGS. 12 and 13 show another bottle 300 for packaging liquids for retail, according to an embodiment of the current disclosure. The bottle 300 is substantially similar to the bottles 100, 200 described above, except as specifically noted and/or shown, or as would be inherent. Further, those skilled in the art will appreciate that the embodiments 100, 200, 300 may be modified in various ways, such as through incorporating all or part of any of the various described embodiments, for example. For uniformity and brevity, reference numbers from 300 to 399 may be used to indicate elements corresponding to those discussed above numbered from 100 to 299 (e.g., package configuration 300*a* corresponds generally to the package configuration 100*a*, 200*a*; alternate configuration 300*b* corresponds generally to the alternate configuration 100*b*, 200*b*; exterior perimeter 310 corresponds generally to the exterior perimeter 110, 210; watertight cavity 311 corresponds generally to the watertight cavity 111, 211; primary spout 314 corresponds generally to the primary spout 114, 214; secondary opening 316 corresponds generally to the secondary opening 116, 216; tube 320 corresponds generally to the tube 120, 220; tube passage 321 corresponds generally to the tube passage 121, 221; tube submersible end 322 corresponds generally to the tube submersible end 122, 222; tube receptacle end 324 corresponds generally to the tube receptacle end 124, 224; tube length portion 326 corresponds generally to the tube length portion 126, 226; primary closure 330 corresponds generally to the primary closure 130, 230; and secondary closure 340 corresponds generally to the secondary closure 140, 240), though with any noted, shown, or inherent deviations.

The bottle 300 primarily differs from the bottles 100, 200 in shape, by omitting the tertiary opening and closure 218, 250 (which may alternately be incorporated as noted above), and by having a permanently-fixed (i.e., irremovable) tube 320.

The secondary opening 316 is shown to be generally circular about a generally horizontal axis 316', and the tube 320 is permanently fixed such that the submersible end 322 is inside the watertight cavity 311 and the receptacle end 324 is outside the watertight cavity 311. The tube 320 may have a single piece construction (even if various different segments are identifiable), or may be constructed of multiple components that may or may not be continuous when combined. In some embodiments, the tube passage 321 has a generally constant diameter throughout the length of the tube passage 321; but in other embodiments, the tube passage 321 has different diameters at different locations along the tube passage 321. The tube 320 has a diffuser 323 at the submersible end 322. Instead of a single opening at the submersible end 322, the diffuser 323 has a plurality of openings 323*a*. This may allow content being added through the tube 320 to be more evenly dispersed into the watertight cavity 311 compared to embodiments having a single opening. And, as with the embodiments 100, 200, the receptacle end 324 may be flared (externally or internally) to act as a funnel for adding content into the watertight cavity 311.

In the embodiment 300, the primary closure 330 and the secondary closure 340 are shown as pressure fittings, though (as with the embodiments 100 and 200) other closures may be used, such as screw caps, threadless bottle caps, swing tops, et cetera. In each of the embodiments, it may be particularly important for user intervention to be required to remove the closures 130, 230, 330, 140, 240, 340, 150, 250. In each of the embodiments described herein (e.g., pressure fittings, screw caps, threadless bottle caps, swing tops, et cetera), the various closures remain in place-even if the watertight cavity 111, 211, 311 is pressurized-until user intervention.

Figure 14:
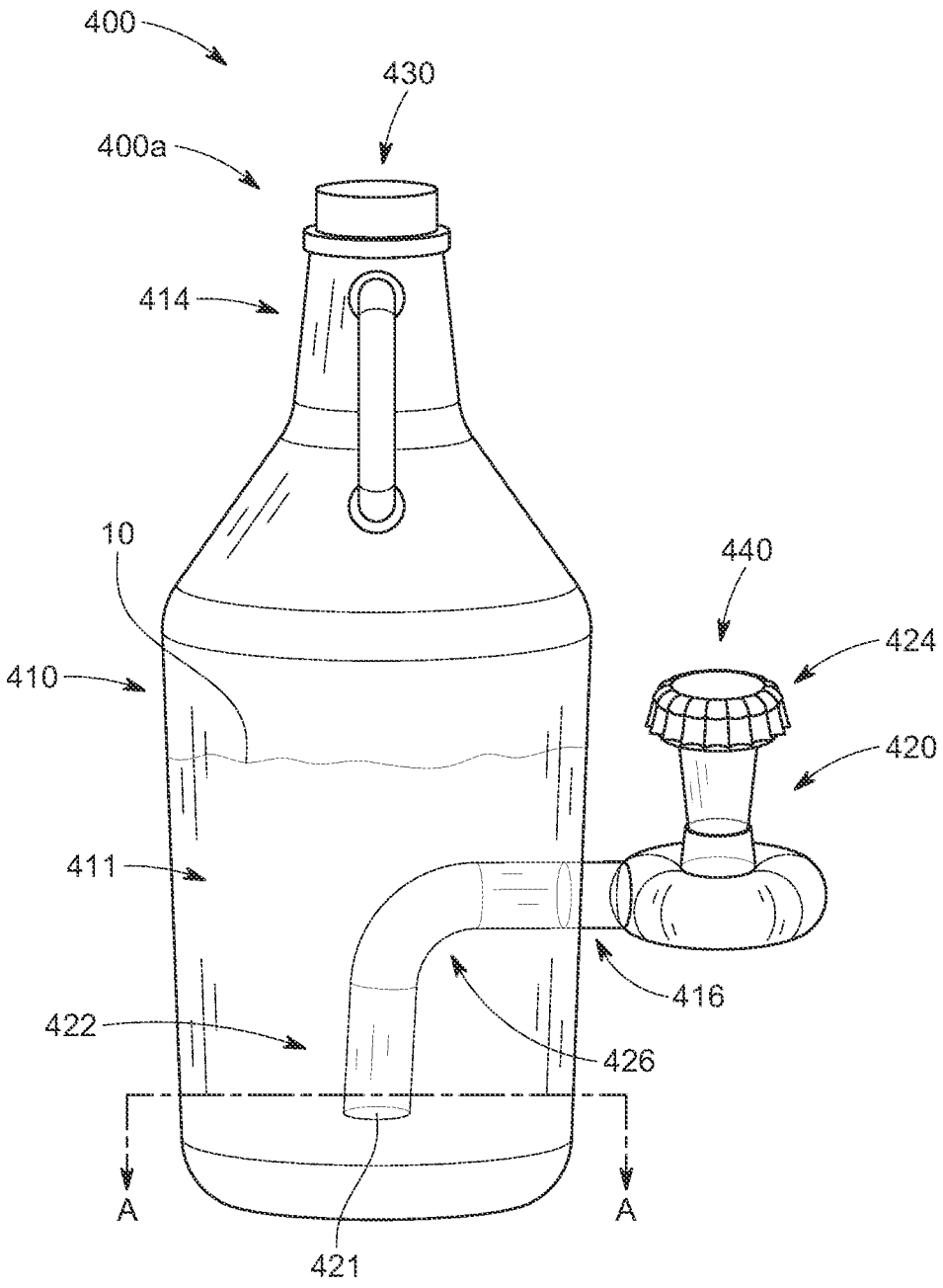
FIG. 14 is a perspective view of a bottle for packaging fluids for retail, according to yet another embodiment of the present disclosure, at a package configuration.
Figure 15:
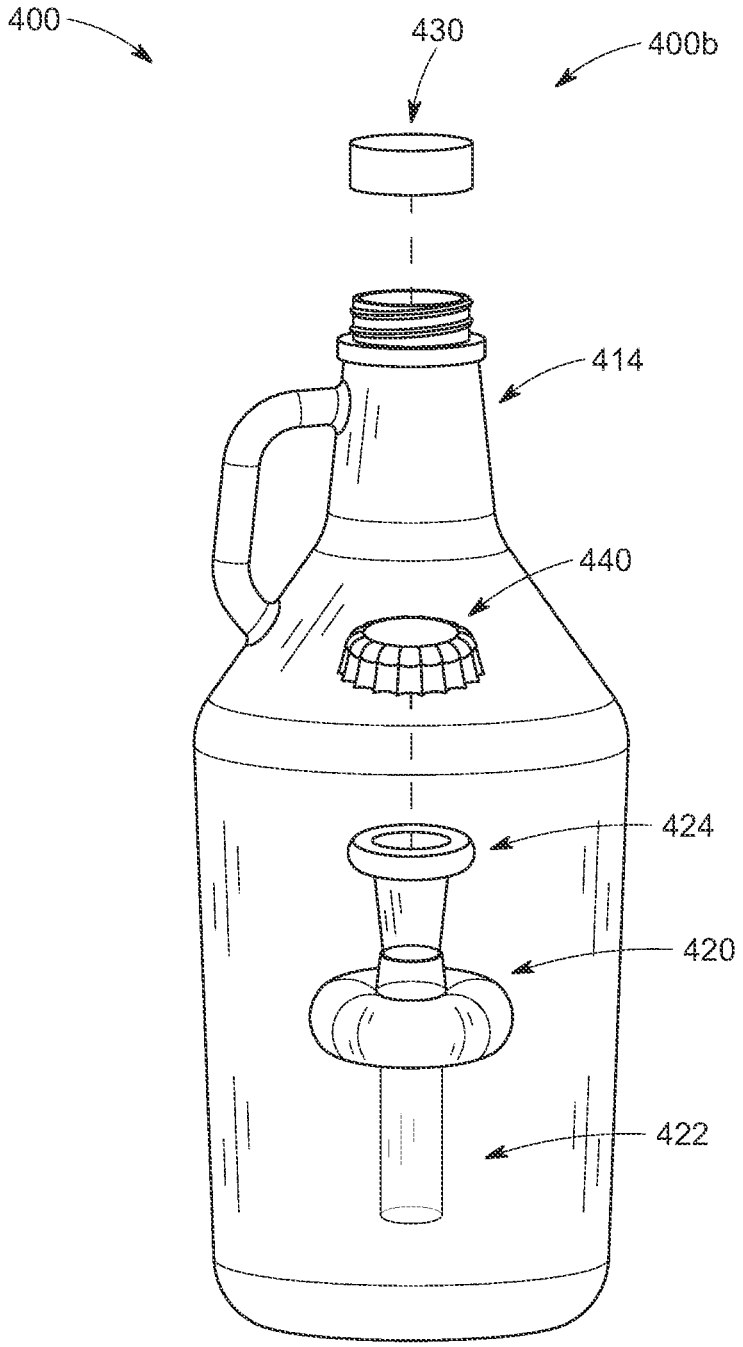
FIG. 15 is another perspective view of the bottle of FIG. 14, with primary and secondary closures removed and not necessarily shown to scale.
Figure 16:
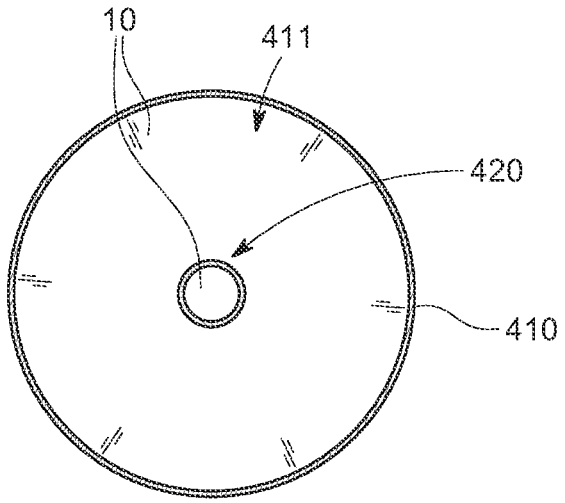
FIG. 16 is a section view taken along plane A-A in FIG. 14.

FIGS. 14 through 16 show another bottle 400 for packaging liquids for retail, according to an embodiment of the current disclosure. The bottle 400 is substantially similar to the bottle 300 described above (which is in turn substantially similar to the bottles 100, 200 described above), except as specifically noted and/or shown, or as would be inherent. Further, those skilled in the art will appreciate that the embodiments 100, 200, 300, 400 may be modified in various ways, such as through incorporating all or part of any of the various described embodiments, for example. For uniformity and brevity, reference numbers from 400 to 499 may be used to indicate elements corresponding to those discussed above numbered from 100 to 399 (e.g., package configuration 400*a* corresponds generally to the package configuration 100*a*, 200*a*, 300*a*; alternate configuration 400*b* corresponds generally to the alternate configuration 100*b*, 200*b*, 300*b*; exterior perimeter 410 corresponds generally to the exterior perimeter 110, 210, 310; watertight cavity 411 corresponds generally to the watertight cavity 111, 211, 311; primary spout 414 corresponds generally to the primary spout 114, 214, 314; secondary opening 416 corresponds generally to the secondary opening 116, 216, 316; tube 420 corresponds generally to the tube 120, 220, 320; tube passage 421 corresponds generally to the tube passage 121, 221, 321; tube submersible end 422 corresponds generally to the tube submersible end 122, 222, 322; tube receptacle end 424 corresponds generally to the tube receptacle end 124, 224, 324; tube length portion 426 corresponds generally to the tube length portion 126, 226, 326; primary closure 430 corresponds generally to the primary closure 130, 230, 330; and secondary closure 440 corresponds generally to the secondary closure 140, 240, 340), though with any noted, shown, or inherent deviations.

The bottle 400 primarily differs from the bottle 300 in shape. Moreover, the bottle 400 is illustrated as having a threaded cap for the primary closure 430 and an unthreaded bottle cap for the secondary closure 440. As described above, each embodiment may have such closures. The shape of the bottle 400 may be particularly desirable for packaging beer, though other liquids may alternately be placed in the watertight cavity 411. Those skilled in the art will appreciate that alcoholic beverages (e.g., beer) are often pressurized, and that the bottle 400 thus may be pressurized while at the package configuration 400*a* (similar to the bottles 100, 200, 300 at the package configurations 100*a*, 200*a*, 300*a*). FIG. 16 shows that in cross section along generally horizontal plane A-A of FIG. 14, the bottle 400 has internal and external unbroken perimeters (formed by the tube 420 and the exterior perimeter 410), and that the liquid 10 is inside each. The liquid 10 inside the tube 420 is in communication with the liquid 10 inside the exterior perimeter 410 at other locations, and may flow between the two.

Figure 17:
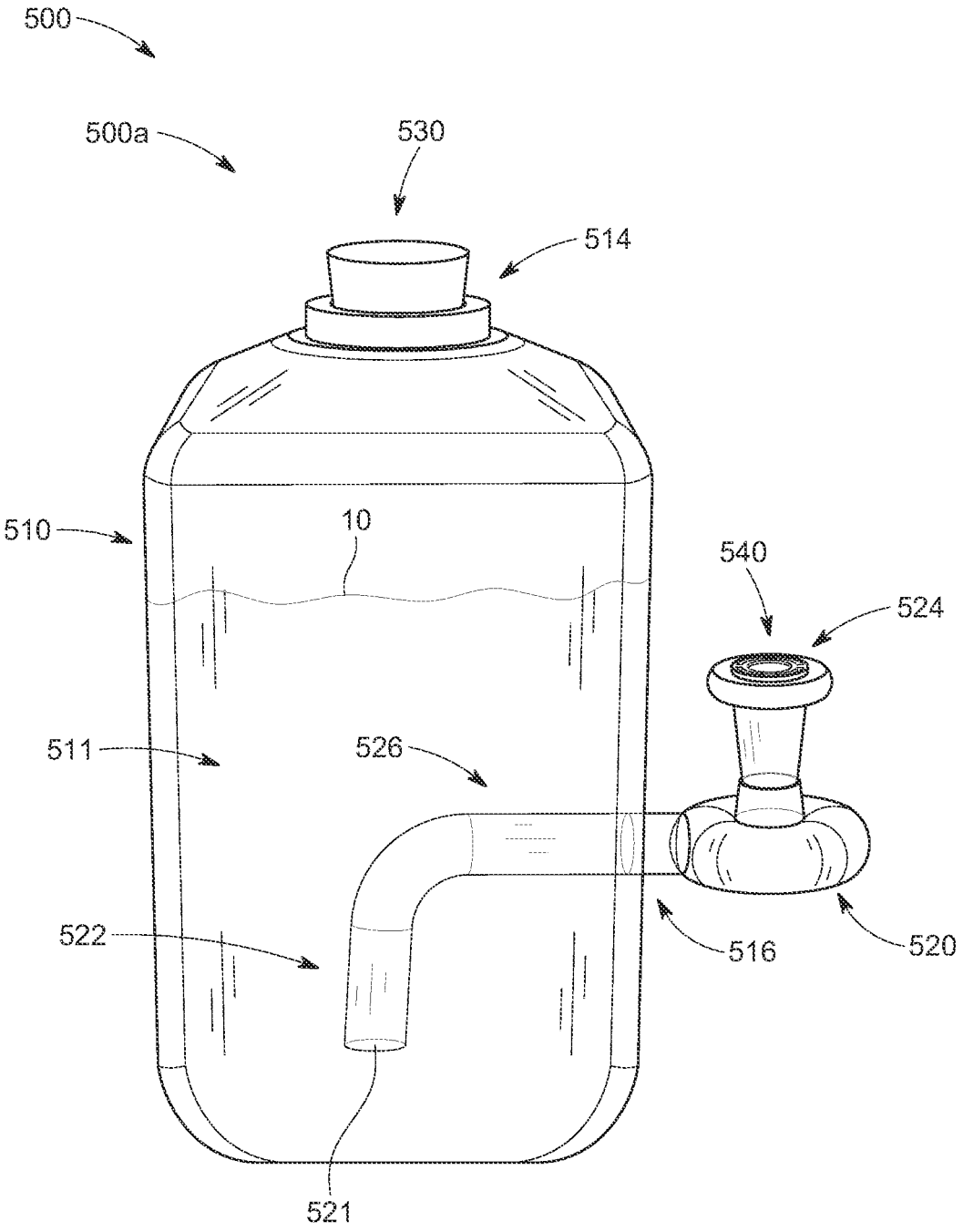
FIG. 17 is a perspective view of a bottle for packaging fluids for retail, according to still yet another embodiment of the present disclosure, at a package configuration.
Figure 18:
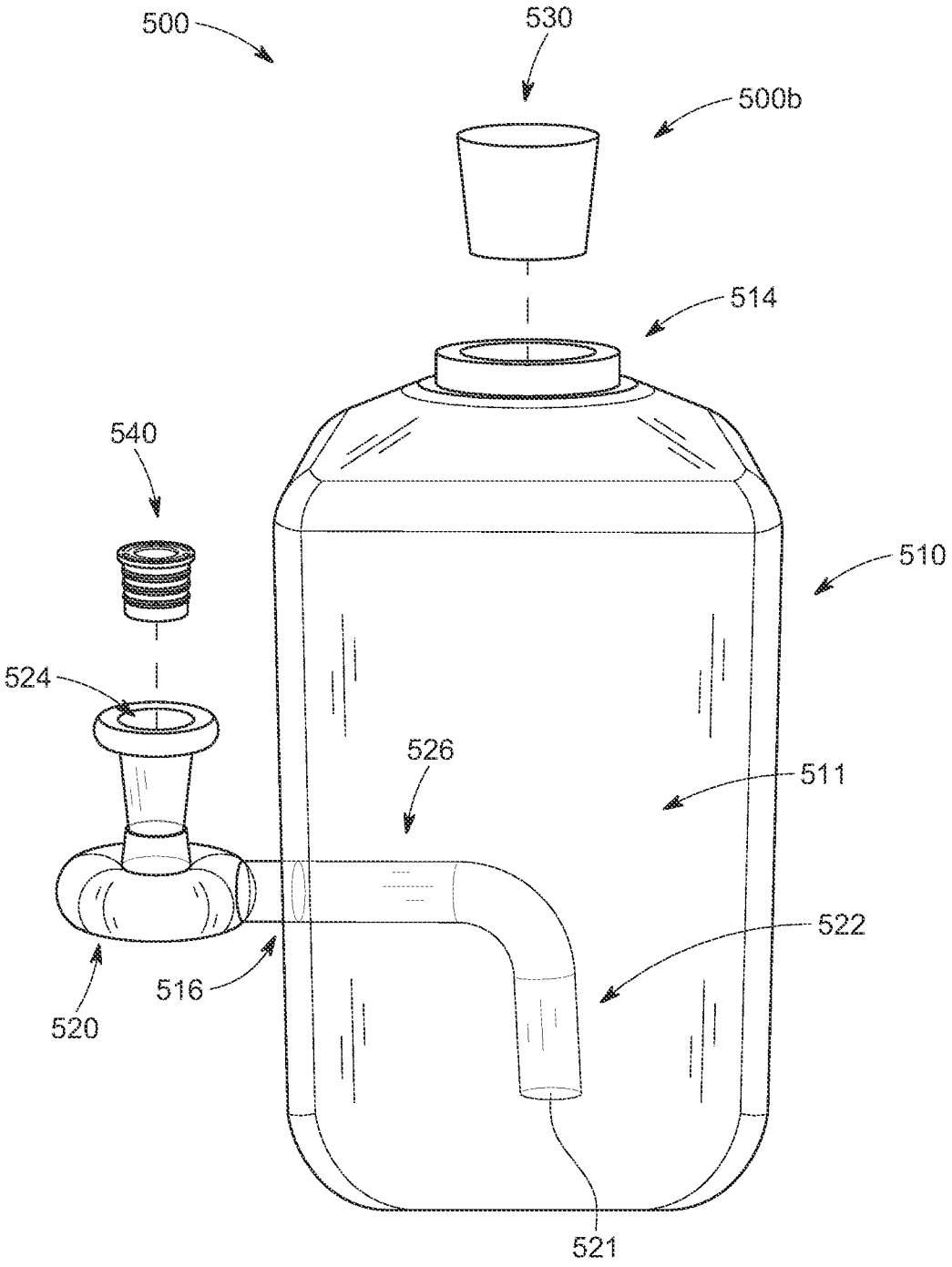
FIG. 18 is another perspective view of the bottle of FIG. 17, with primary and secondary closures removed and not necessarily shown to scale.

FIGS. 17 and 18 show another bottle 500 for packaging liquids for retail, according to an embodiment of the current disclosure. The bottle 500 is substantially similar to the bottle 300 described above (which is in turn substantially similar to the bottles 100, 200, 400 described above), except as specifically noted and/or shown, or as would be inherent. Further, those skilled in the art will appreciate that the embodiments 100, 200, 300, 400, 500 may be modified in various ways, such as through incorporating all or part of any of the various described embodiments, for example. For uniformity and brevity, reference numbers from 500 to 599 may be used to indicate elements corresponding to those discussed above numbered from 100 to 499 (e.g., package configuration 500*a* corresponds generally to the package configuration 100*a*, 200*a*, 300*a*, 400*a*; alternate configuration 500*b* corresponds generally to the alternate configuration 100*b*, 200*b*, 300*b*, 400*b*; exterior perimeter 510 corresponds generally to the exterior perimeter 110, 210, 310, 410; watertight cavity 511 corresponds generally to the watertight cavity 111, 211, 311, 411; primary spout 514 corresponds generally to the primary spout 114, 214, 314, 414; secondary opening 516 corresponds generally to the secondary opening 116, 216, 316, 416; tube 520 corresponds generally to the tube 120, 220, 320, 420; tube passage 521 corresponds generally to the tube passage 121, 221, 321, 421; tube submersible end 522 corresponds generally to the tube submersible end 122, 222, 322, 422; tube receptacle end 524 corresponds generally to the tube receptacle end 124, 224, 324, 424; tube length portion 526 corresponds generally to the tube length portion 126, 226, 326, 426; primary closure 530 corresponds generally to the primary closure 130, 230, 330, 430; and secondary closure 540 corresponds generally to the secondary closure 140, 240, 340, 440), though with any noted, shown, or inherent deviations. The bottle 500 primarily differs from the bottle 300 in shape.

Figure 19:
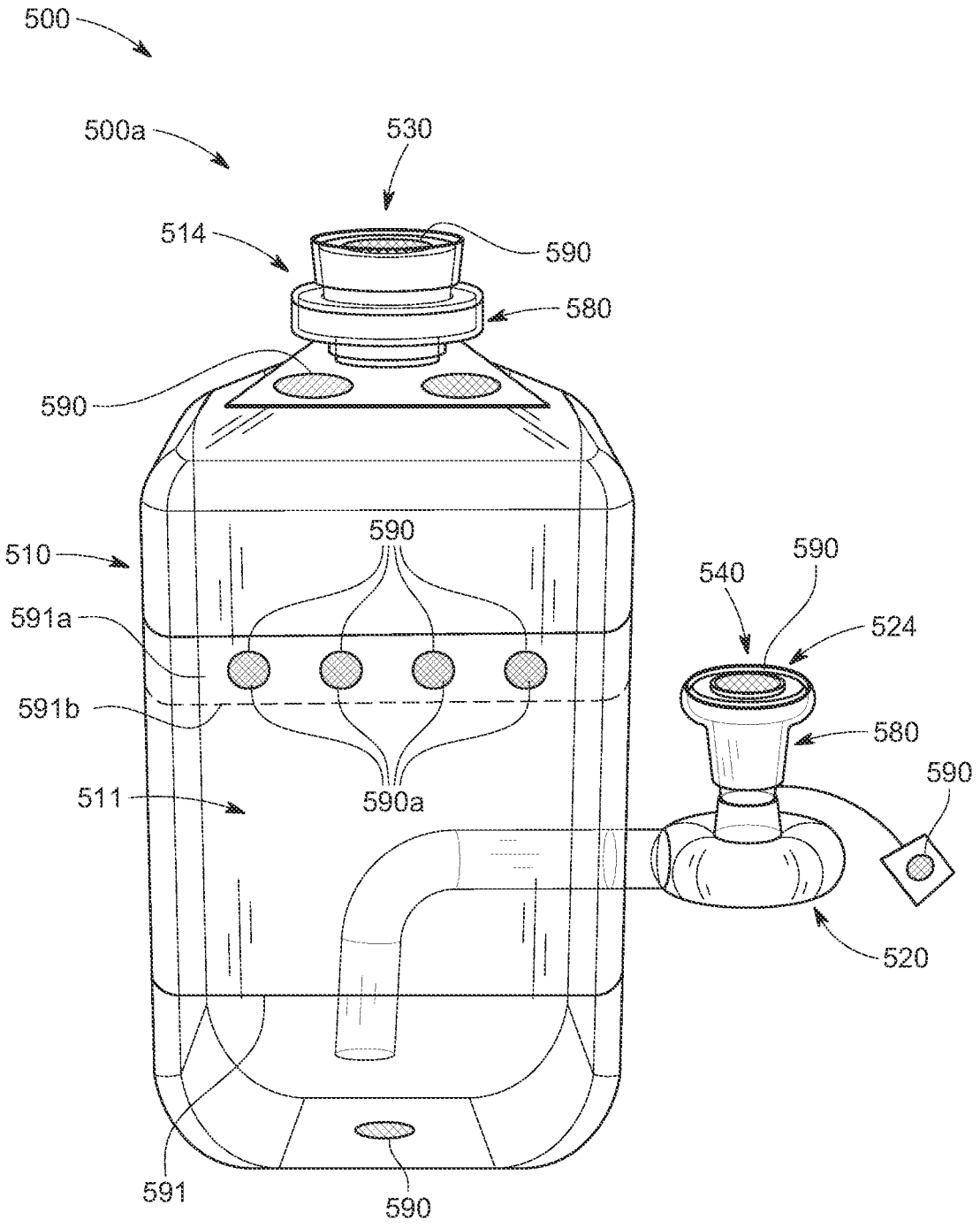
FIG. 19 is still another perspective view of the bottle of FIG. 17 at the package configuration, with additional features illustrated.

FIG. 19 shows the bottle 500 with additional features illustrated. More particularly, FIG. 19 illustrates tamper-indicating seals (as discussed above regarding embodiment 100) and various filters. Tamper-indicating seals 580 may, for example, include shrink wrap, wax, stickers, or other elements applied to any or all of the closures to ensure that the closures remain in place and also provide tamper-indicating seals. In other words, the tamper-indicating seals 580 may be applied to the closures to restrict or indicate access to the closures.

Filters 590 are configured to be placed in the tube receptacle end 524 of the tube 520 to filter the content being added to the watertight cavity 511 when then bottle 500 is at the alternate configuration 500*b*. The filters (or "screens") 590 may be made of various materials, such as wire screens, cloth, et cetera. In practice, one or more of the filters 590 may be included. The bottle 500 is shown at the package configuration 500*a* having the filters 590 coupled to floor 512 (which corresponds generally to the floor 112), at least one external wall 513 (which corresponds generally to the at least one external wall 113), the primary spout 514, the primary closure 530, the secondary closure 540, and the tube 520. In practice, one or more of the filters 590 may be included. The filters 590 may be coupled by adhesive, wax, labeling, laminate, shrink wrap, stickers, strings, et cetera. Filters 590*a* may be on top of, underneath, or integral with labeling 591, and it may be particularly desirable for area 591*a* of the labeling 591 to be separable from a remainder of the labeling 591 (e.g., by a line of perforations 591*b*).

As noted repeatedly herein, each embodiment may be modified by incorporating or omitting features disclosed in other embodiments. As merely some examples of such combinations, the tertiary openings and closures may be added to embodiments illustrated without such tertiary openings and closures; tertiary openings and closures may be omitted from embodiments illustrated with such tertiary openings and closures; the various illustrated bottle shapes (or other shapes) may be used; tamper-indicating seals may be added to embodiments illustrated without such tamper-indicating seals; tamper-indicating seals may be omitted from embodiments illustrated with such tamper-indicating seals; one or more filter may be added to embodiments illustrated without such a filter; and filters may be omitted from embodiments illustrated with such filters.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims.

The invention claimed is:

1. A bottle having a package configuration for packaging a liquid for retail and having an alternate configuration for adding content into the bottle, the bottle comprising:

a floor defining an impermeable bottom;

at least one wall extending upwardly from an outer perimeter of the floor, the floor and the at least one wall extending upwardly from the outer perimeter of the floor collectively defining a watertight cavity;

a primary spout in communication with the watertight cavity, the primary spout having a distal opening with an internal perimeter located entirely inwardly of the outer perimeter of the floor;

a secondary passage in communication with the watertight cavity, the secondary passage having a distal opening with an internal perimeter that is smaller than the internal perimeter of the primary spout distal opening, the internal perimeter of the distal opening of the secondary passage being located entirely outwardly of the outer perimeter of the floor;

a tube located at the secondary passage and having a submersible end and a receptacle end; the submersible end being inside the watertight cavity; when the bottle is at the alternate configuration, the receptacle end being outside the watertight cavity to add content into the watertight cavity; the receptacle end having an internal perimeter that is larger than the internal perimeter of the distal opening of the secondary passage; the receptacle end being flared;

a primary closure; and a secondary closure;

wherein the primary closure and the secondary closure are configured such that:

at the package configuration, the primary closure prevents the liquid from spilling from the bottle through the primary spout and the secondary closure prevents the liquid from spilling from the bottle through the secondary passage; and at the alternate configuration, the primary closure does not prevent the liquid from spilling from the bottle through the primary spout and the secondary closure does not prevent the liquid from spilling from the bottle through the secondary passage; user intervention being required to alter the primary closure and the secondary closure from the package configuration to the alternate configuration.

2. The bottle of claim 1, wherein the tube receptacle end is removable relative to the watertight cavity.

3. The bottle of claim 1, wherein the tube is removable relative to the watertight cavity.

4. The bottle of claim 1, wherein an unobstructed passage extends entirely through the tube from the submersible end to the receptacle end.

5. The bottle of claim 1, further comprising:

a tertiary passage located along the at least one wall or the primary spout and being in communication with the watertight cavity; and a tertiary closure configured to removably seal the tertiary passage.

6. The bottle of claim 1, wherein the at least one wall extending upwardly from the outer perimeter of the floor has a curved lower portion that contacts the outer perimeter of the floor.

7. The bottle of claim 1, wherein the floor is concave.

8. A bottled liquid, comprising:

the bottle of claim 1 at the package configuration; and a liquid sealed in the watertight cavity.

9. The bottled liquid of claim 8, wherein the liquid is an alcoholic beverage.

10. The bottled liquid of claim 9, wherein the liquid is pressurized when the bottle is at the package configuration.

11. The bottle of claim 1, wherein at least part of the tube is coupled to the primary closure when the bottle is at the package configuration.

12. The bottle of claim 11, wherein the tube is separated from the primary closure when the bottle is at the alternate configuration.

13. The bottle of claim 1, wherein at least part of the tube extends inside the primary spout when the bottle is at the package configuration.

14. The bottle of claim 13, further comprising a stabilizer coupled to the tube for stabilizing the tube inside the bottle when the bottle is at the package configuration.

15. The bottle of claim 14, wherein:

the stabilizer is removably coupled to the tube; and the stabilizer is separated from the tube when the bottle is at the alternate configuration.

16. The bottle of claim 14, wherein the flared receptacle end of the tube is inside the bottle when the bottle is at the package configuration.

17. A bottle having a package configuration for packaging a liquid for retail and having an alternate configuration for adding content into the bottle, the bottle comprising:

a floor defining an impermeable bottom;

at least one wall extending upwardly from an outer perimeter of the floor, the floor and the at least one wall extending upwardly from the outer perimeter of the floor collectively defining a watertight cavity;

a primary spout in communication with the watertight cavity, the primary spout having a distal opening with an internal perimeter;

a secondary passage in communication with the watertight cavity, the secondary passage having a distal opening with an internal perimeter that is smaller than the internal perimeter of the primary spout distal opening;

a tube located at the secondary passage and having a submersible end and a receptacle end; the submersible end being inside the watertight cavity; when the bottle is at the alternate configuration, the receptacle end being outside the watertight cavity to add content into the watertight cavity; the receptacle end having an internal perimeter that is larger than the internal perimeter of the distal opening of the secondary passage;

a primary closure; and a secondary closure;

wherein the primary closure and the secondary closure are configured such that:

at the package configuration, the primary closure prevents the liquid from spilling from the bottle through the primary spout and the secondary closure prevents the liquid from spilling from the bottle through the secondary passage; and at the alternate configuration, the primary closure does not prevent the liquid from spilling from the bottle through the primary spout and the secondary closure does not prevent the liquid from spilling from the bottle through the secondary passage; user intervention being required to alter the primary closure and the secondary closure from the package configuration to the alternate configuration; and wherein either:

the internal perimeter of the distal opening of the primary spout is located entirely inwardly of the outer perimeter of the floor and the internal perimeter of the distal opening of the secondary passage is located entirely outwardly of the outer perimeter of the floor, or the internal perimeter of the distal opening of the primary spout is located entirely outwardly of the outer perimeter of the floor and the internal perimeter of the distal opening of the secondary passage is located entirely inwardly of the outer perimeter of the floor.

18. The bottle of claim 17, wherein the receptacle end of the tube is flared.

19. The bottle of claim 17, wherein the secondary passage has a proximal opening that is generally circular about a generally horizontal axis.

20. A bottled liquid, comprising:

the bottle of claim 17 at the package configuration; and a liquid sealed in the watertight cavity.

21. The bottled liquid of claim 20, wherein at the package configuration, a cross-section taken along a plane generally parallel to the floor reveals internal and external unbroken boundaries separated from one another, a first portion of the liquid being inside the internal unbroken boundary, a second portion of the liquid being outside the internal unbroken boundary and inside the external unbroken boundary, the first portion of the liquid being in communication with the second portion of the liquid.

22. The bottled liquid of claim 20, further comprising at least one item selected from the group consisting of:

a tamper-indicating seal applied to the primary closure to restrict or indicate access to the primary closure; and a tamper-indicating seal applied to the secondary closure to restrict or indicate access to the secondary closure.

23. The bottled liquid of claim 20, wherein the liquid is an alcoholic beverage.

24. The bottle of claim 17, wherein at least part of the tube is removable relative to the watertight cavity.

25. The bottle of claim 17, wherein the at least one wall extending upwardly from the outer perimeter of the floor has a curved lower portion that contacts the outer perimeter of the floor.

26. The bottle of claim 17, wherein the tube is coupled to the primary closure when the bottle is at the package configuration.

27. The bottle of claim 17, wherein at least part of the tube is coupled to the primary closure when the bottle is at the package configuration.

28. The bottle of claim 27, wherein the tube is separated from the primary closure when the bottle is at the alternate configuration.

29. The bottle of claim 17, wherein at least part of the tube extends inside the primary spout when the bottle is at the package configuration.

30. The bottle of claim 29, further comprising a stabilizer coupled to the tube for stabilizing the tube inside the bottle when the bottle is at the package configuration.

31. The bottle of claim 30, wherein:

the stabilizer is removably coupled to the tube; and the stabilizer is separated from the tube when the bottle is at the alternate configuration.

32. The bottle of claim 17, wherein the flared receptacle end of the tube is inside the bottle when the bottle is at the package configuration.

* * * * *